US008366036B2

(12) United States Patent
Ozaki et al.

(10) Patent No.: US 8,366,036 B2
(45) Date of Patent: Feb. 5, 2013

(54) RECORDING APPARATUS

(75) Inventors: Kazuma Ozaki, Okaya (JP); Takuya Yasue, Matsumoto (JP); Kiyoto Komuro, Okaya (JP); Yasuharu Harada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 486 days.

(21) Appl. No.: 12/393,781

(22) Filed: Feb. 26, 2009

(65) Prior Publication Data

US 2009/0212152 A1 Aug. 27, 2009

(30) Foreign Application Priority Data

Feb. 27, 2008 (JP) ..... 2008-046542
Oct. 10, 2008 (JP) ..... 2008-263985

(51) Int. Cl.
*B65H 49/18* (2006.01)

(52) U.S. Cl. ..... 242/596.1; 242/599.4; 242/613

(58) Field of Classification Search ..... 242/578, 242/578.2, 596, 596.1, 596.4, 596.7, 599, 242/599.4, 599.3; 400/611, 613, 120.16
See application file for complete search history.

(56) References Cited

U.S. PATENT DOCUMENTS

| | | | | |
|---|---|---|---|---|
| 1,811,779 | A * | 6/1931 | Caps | 242/596.1 |
| 6,491,252 | B2 * | 12/2002 | Komatsu et al. | 242/596.1 |
| 6,616,086 | B2 * | 9/2003 | Nakamura et al. | 242/596.5 |
| 6,695,500 | B2 * | 2/2004 | Kim et al. | 400/613 |
| 6,874,958 | B1 * | 4/2005 | Panebianco et al. | 400/243 |
| 2001/0054667 | A1 * | 12/2001 | Komatsu et al. | 242/596.1 |
| 2003/0155462 | A1 * | 8/2003 | Takeda et al. | 242/578 |
| 2009/0194631 | A1 * | 8/2009 | Genta et al. | 400/611 |

FOREIGN PATENT DOCUMENTS

| | | |
|---|---|---|
| JP | 11-116109 | 4/1999 |
| JP | 2005-239412 | 9/2005 |
| JP | 2007-261754 | 10/2007 |

* cited by examiner

*Primary Examiner* — William A Rivera
(74) *Attorney, Agent, or Firm* — Maschoff Gilmore & Israelsen

(57) ABSTRACT

A recording apparatus includes: a recording unit that performs recording on a recording medium wound on a roll, the roll including a first flange that is attached to one end and has a shaft hole and a first receiving portion, and a second flange that is attached to the other end and has a shaft hole; a first holder movable along a rotation axis of the roll, the first holder including a first shaft insertable into the shaft hole in the first flange, and a first flange-support surface that is in contact with an outer periphery of the first flange to support the first flange when the first shaft is not fitted in the shaft hole in the first flange and that has a first engaging portion; a second holder including a second shaft insertable into the shaft hole in the second flange.

7 Claims, 20 Drawing Sheets

RECORDING APPARATUS

BACKGROUND

1. Technical Field

The present invention relates to recording apparatuses, such as facsimiles and printers, in which a roll around which a recording medium is wound (for example, a rolled sheet) can be set.

2. Related Art

Recording apparatuses, such as facsimiles and printers, often use a rolled sheet, which serves as a recording medium. Holders in which a rolled sheet body, i.e., a roll around which a sheet is wound, is set (rolled-sheet holders) in a recording apparatus are available in various configurations. JP-A-2007-261754 discloses an example of such holders. In the recording apparatus disclosed in JP-A-2007-261754, flange members are fitted to both ends of a roll and the flange members are supported by shafts (support shafts). Thus, the roll is set.

More specifically, one support shaft for supporting the flange members is provided on a fixed flange receiver and the other support shaft is provided on a movable flange receiver. Before the roll is set, the flange members are placed on the fixed and movable flange receivers. By sliding the movable flange receiver toward the fixed flange receiver in this state, the flange members fitted to both ends of the roll are fitted to the support shaft of the movable flange receiver and the support shaft on the fixed flange. Thus, the roll is set.

In the recording apparatus disclosed in JP-A-2007-261754, when the roll is to be removed the flanges at both ends of the roll need to be disengaged from the support shafts by moving the movable flange receiver away from the fixed flange receiver. However, if the flanges and the support shafts are incompletely disengaged from each other, the roll could be removed while portions of the support shafts are still fitted in the flanges.

If the roll is to be removed while portions of the support shafts are still fitted in the flanges, the support shafts may be deformed or damaged, making it impossible to appropriately support the roll.

SUMMARY

An advantage of some aspects of the invention is that it provides a recording apparatus that certainly disengages flanges fitted to both ends of a roll from shafts fitted in shaft holes in the flanges, preventing the shafts for supporting the flanges from being deformed or damaged.

A recording apparatus according to a first aspect of the invention includes: a recording unit that performs recording on a recording medium wound on a roll, the roll including a first flange that is attached to one end and has a shaft hole and a first receiving portion, and a second flange that is attached to the other end and has a shaft hole; a first holder movable along a rotation axis of the roll, the first holder including a first shaft insertable into the shaft hole in the first flange, and a first flange-support surface that is in contact with an outer periphery of the first flange to support the first flange when the first shaft is not fitted in the shaft hole in the first flange and that has a first engaging portion; a second holder including a second shaft insertable into the shaft hole in the second flange, a second flange-support surface that is in contact with an outer periphery of the second flange to support the second flange when the second shaft is not fitted in the shaft hole in the second flange, and a flange guide mechanism that guides the second flange to a reference position located on the second holder side. When the first holder is moved away from the second holder while the first and second shafts are fitted in the shaft holes in the first and second flanges, respectively, the first engaging portion engages with the first receiving portion to move the roll along with the first holder away from the second holder.

Because the second holder includes the flange guide mechanism that guides the second flange to the reference position located on the second holder side, when the first holder is moved away from the second holder while the roll is in a set state (a state in which the first and second shafts are fitted in the shaft holes in the first and second flanges, respectively), the first shaft tends to be easily removed from the shaft hole in the first flange before the second shaft is removed from the shaft hole in the second flange. Thus, the second shaft is incompletely removed from the shaft hole in the second flange. If the roll is to be removed while a portion of the second shaft is still fitted in the shaft hole in the second flange, the second shaft may be deformed or damaged.

However, the first flange-support surface of the first holder has the first engaging portion that causes the roll to move along with the first holder away from the second holder when the first holder is moved away from the second holder while the roll is in a set state. Thus, when the roll moves along with the first holder away from the second holder, the second shaft is appropriately removed from the shaft hole in the second flange. Accordingly, the second shaft can be certainly prevented from being incompletely removed from the shaft hole in the second flange and thus deformed or damaged.

A second aspect of the invention is the recording apparatus according to the first aspect, wherein the second flange has a second receiving portion, and wherein the second flange-support surface has a second engaging portion engagable with the second receiving portion to limit movement of the roll toward the first holder.

When the first holder is moved away from the second holder while the roll is in a set state, if the second shaft is removed from the shaft hole in the second flange before the first shaft is removed from the shaft hole in the first flange, the roll moves along with the first holder without the first shaft being removed from the shaft hole in the first flange. As a result, the first shaft is incompletely removed from the shaft hole in the first flange. If the roll is to be removed in this state, the first shaft may be deformed or damaged.

However, because the second flange-support surface has the second engaging portion engagable with the second receiving portion to limit movement of the roll toward the first holder, even if the roll moves along with the first holder without the first shaft being removed from the shaft hole in the first flange, the movement of the roll is eventually stopped. As a result, the first shaft can be appropriately removed from the shaft hole in the first flange. Accordingly, the first shaft can be prevented from being deformed or damaged.

A third aspect of the invention is the recording apparatus according to the first aspect, wherein the flange guide mechanism includes a boss provided inside the shaft hole in the second flange and a guide groove that is formed in the second shaft and guides the boss to a guide position as the second shaft rotates. According to this aspect, it is possible to form the flange guide mechanism in a simple structure and at low cost.

A recording apparatus according to a fourth aspect of the invention includes: a recording unit that performs recording on a recording medium wound on a roll, the roll including a first flange that is attached to one end and has a shaft hole and a first receiving portion, and a second flange that is attached to the other end and has a shaft hole and a second receiving portion; a first holder movable along a rotation axis of the roll, the first holder including a first shaft insertable into the shaft hole in the first flange, and a first flange-support surface that is in contact with an outer periphery of the first flange to support the first flange when the first shaft is not fitted in the shaft hole in the first flange and that has a first engaging portion; a second holder including a second shaft insertable into the shaft hole in the second flange, and a second flange-support surface that is in contact with an outer periphery of the second flange to support the second flange when the second shaft is not fitted in the shaft hole in the second flange and that has a second engaging portion engagable with the second receiving portion to limit movement of the roll toward the first holder. When the first holder is moved away from the second holder while the first and second shafts are fitted in the shaft holes in the first and second flanges, respectively, the first engaging portion engages with the first receiving portion to move the roll along with the first holder away from the second holder.

When the first holder is moved away from the second holder while the roll is in a set state, which of the first and second shafts is removed from the corresponding shaft holes first depends on the fitting strengths between the first shaft and the shaft hole in the first flange and between the second shaft and the shaft hole in the second flange. Therefore, for example, if the first shaft is removed from the shaft hole in the first flange before the second shaft is removed from the shaft hole in the second flange, the second shaft is incompletely removed from the shaft hole in the second flange. If the roll is to be removed in this state, the second shaft may be deformed or damaged.

In contrast, if the second shaft is removed from the shaft hole in the second flange before the first shaft is removed from the shaft hole in the first flange, the first shaft is incompletely removed from the shaft hole in the first flange. If the roll is to be removed in this state, the first shaft may be deformed or damaged.

However, in this aspect, the first flange-support surface of the first holder has the first engaging portion that causes the roll to move along with the first holder away from the second holder when the first holder is moved away from the second holder while the roll is in a set state. Thus, the roll moves along with the first holder away from the second holder, appropriately removing the second shaft from the shaft hole in the second flange. Accordingly, the second shaft can be certainly prevented from being incompletely removed from the shaft hole in the second flange and thus deformed or damaged.

In addition, the second flange-support surface of the second holder has the second engaging portion engagable with the second receiving portion to limit movement of the roll toward the first holder. Thus, even if the roll moves along with the first holder without the first shaft being removed from the shaft hole in the first flange, the movement of the roll is eventually stopped. As a result, the first shaft is appropriately removed from the shaft hole in the first flange. Accordingly, the first shaft can be prevented from being deformed or damaged.

A fifth aspect of the invention is the recording apparatus according to the first aspect, wherein the first flange-support surface and the second flange-support surface are shaped so as not to interfere with outer peripheral corners of the roll when the first flange-support surface and the second flange-support surface support the first flange and the second flange, respectively.

According to this aspect, because the first flange-support surface and the second flange-support surface are shaped so as not to interfere with the outer peripheral corners of the roll, when the roll is set or removed, the outer peripheral corners of the roll (i.e., the side ends of the recording medium) can be prevented from interfering with the first flange-support surface and the second flange-support surface and being damaged.

A sixth aspect of the invention is the recording apparatus according to the first aspect, further including a wall portion provided so as to face an outer circumference of at least one of the first and second flanges when the first and second shafts are fitted in the shaft holes in the first and second flanges, respectively, at a position adjacent to a position from which the roll is to be set to a position where the roll is supported by the first and second holders.

According to this aspect, the recording apparatus has the wall portion provided so as to face the outer circumference of at least one of the first and second flanges when the roll is in a set state, at the position adjacent to the position from which the roll is to be set to the position where the roll is supported by the first and second holders. This wall portion allows a user to visually recognize that the roll is removable. Accordingly, it is possible to prevent the user from trying to remove the roll in a set state and the first or second shaft, or the first and second shafts, from being damaged.

A seventh aspect of the invention is the recording apparatus according to the first aspect, further including: a temporary placing portion on which the roll, to which the first and second flanges are attached, is temporarily placed, the temporary placing portion being provided at a position a predetermined distance away from the first and second holders in a direction perpendicular to the rotation axis of the first and second shafts; and a projection member arranged in at least one of a path in which the first flange collides with the first shaft and a path in which the second flange collides with the second shaft when the roll is moved from the temporary placing portion to a position where the roll is supported by the first and second holders.

According to this aspect, the projection member is arranged in at least one of the path in which the first flange collides with the first shaft and the path in which the second flange collides with the second shaft when the roll is moved from the temporary placing portion to the position where the roll is supported by the first and second holders. This projection member can prevent the first flange attached to one end of the roll from colliding with the first shaft or the second flange from colliding with the second shaft, or, both the first and second flanges from colliding with the corresponding shafts. Accordingly, it is possible to prevent the first and second shafts supporting the roll from being deformed or damaged and thus failing to appropriately support the roll.

A recording apparatus according to an eighth aspect of the invention includes: a recording unit that performs recording on a recording medium wound on a roll, the roll including a first flange that is attached to one end and has a shaft hole, and a second flange that is attached to the other end and has a shaft hole; a first holder movable along a rotation axis of the roll, the first holder including a first shaft insertable into the shaft hole in the first flange, a second holder including a second shaft insertable into the shaft hole in the second flange, and a shaft-removing mechanism that moves the roll along with the first holder away from the second holder when the first holder is moved away from the second holder while the first and second shafts are fitted in the shaft holes in the first and second flanges, respectively, to remove the second shaft from the shaft hole in the second flange before the first shaft is removed from the shaft hole in the first flange.

This aspect intends to solve the following technical problem. When a user moves the first holder to remove the roll, the user performs the operation on the first holder side. Thus, if the roll is long, it is sometimes difficult for the user to view whether the second shaft is removed from the second flange on the second holder side. As a result, the user sometimes tries to remove the roll without the second shaft being completely removed from the second flange, and thus, the user may bend the second shaft or damage the second flange.

In this aspect, the shaft-removing mechanism is provided. As a result, when the first holder is moved, the second shaft is removed from the shaft hole in the second flange on the second holder side before the first shaft is removed from the shaft hole in the first flange on the first holder side. Thus, the above-described problem can be certainly prevented.

A ninth aspect of the invention is the recording apparatus according to the eighth aspect, wherein the first flange further has a flange-side engaging portion, wherein the first holder further has a holder-side engaging portion engagable with the flange-side engaging portion to move the roll along with the first holder away from the second holder, and wherein the shaft-removing mechanism has the holder-side engaging portion. According to this aspect, the shaft-removing mechanism can be formed in a simple structure and at low cost.

A tenth aspect of the invention is the recording apparatus according to the ninth aspect, wherein the holder-side engaging portion is positioned so as to engage with the flange-side engaging portion after the first holder is moved away from the second holder by a predetermined distance, when the first shaft is fitted in the shaft hole in the first flange.

According to this aspect, when the roll is in a set state, the holder-side engaging portion can be prevented from colliding with the first flange (flange-side engaging portion). Thus, the holder-side engaging portion can be prevented from affecting the rotation of the roll.

An eleventh aspect of the invention is the recording apparatus according to the ninth aspect, wherein the holder-side engaging portion is movable between a projected position where the holder-side engaging portion projects toward the flange-side engaging portion and a retracted position where the holder-side engaging portion is retracted from the projected position by a predetermined amount. According to this aspect, because the holder-side engaging portion is movable between the projected position and the retracted position, the holder-side engaging portion can be retracted when the first flange is set (fitted) to the first holder (first shaft). Accordingly, the first flange can be set to the first holder smoothly.

A twelfth aspect of the invention is the recording apparatus according to the eleventh aspect, further including an urging member. The urging member exerts an urging force on the holder-side engaging portion when the holder-side engaging portion moves from the projected position to the retracted position and does not exert the urging force on the holder-side engaging portion when the holder-side engaging portion is at the projected position.

According to this aspect, the urging member restrains the holder-side engaging portion from being easily retracted to the retracted position but does not exert an urging force while the holder-side engaging portion is at the projected position. Accordingly, plastic deformation due to the urging force always acting on the holder-side engaging portion and the surrounding components can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
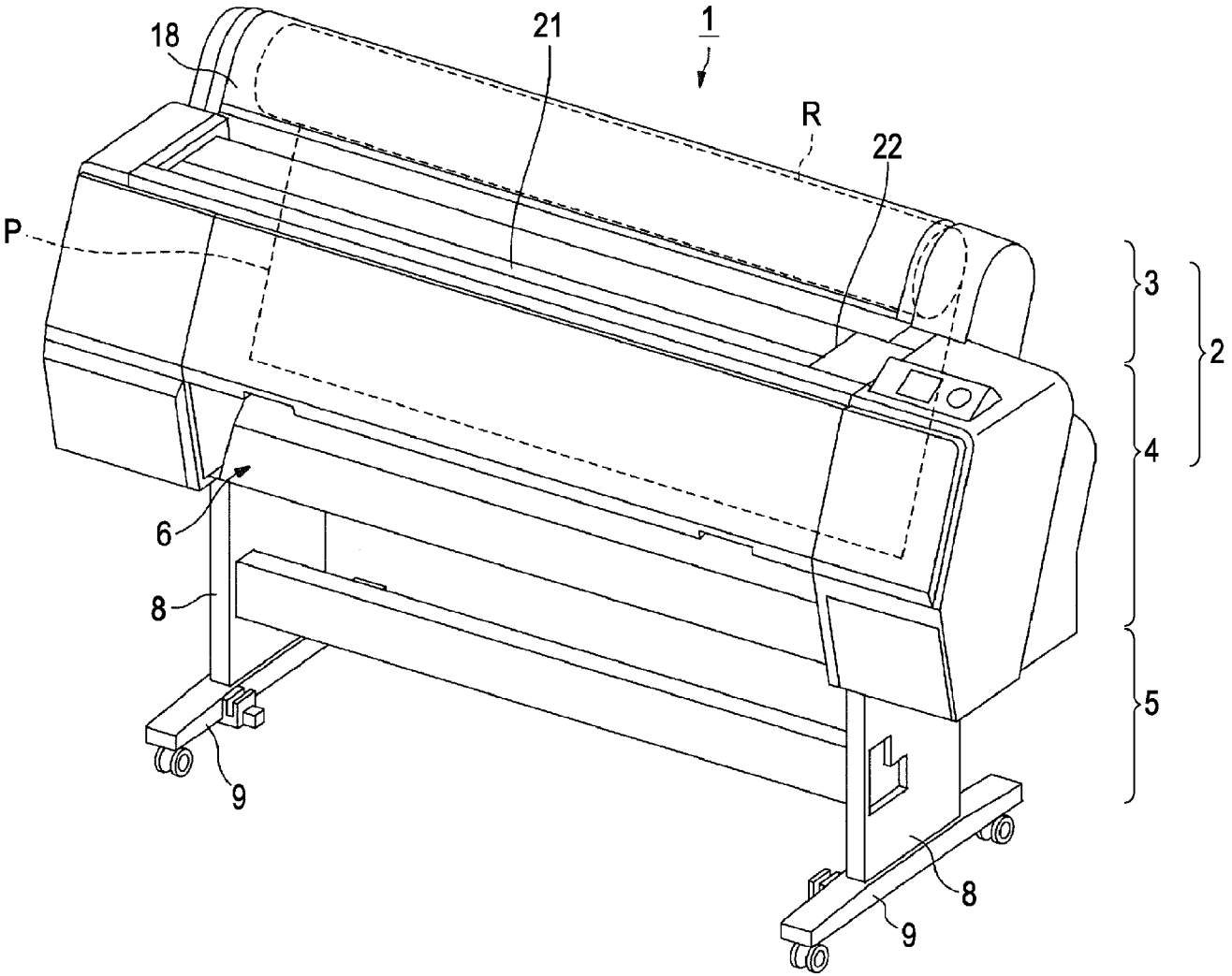
FIG. 1 is an external perspective view of a printer of the invention.
Figure 2:
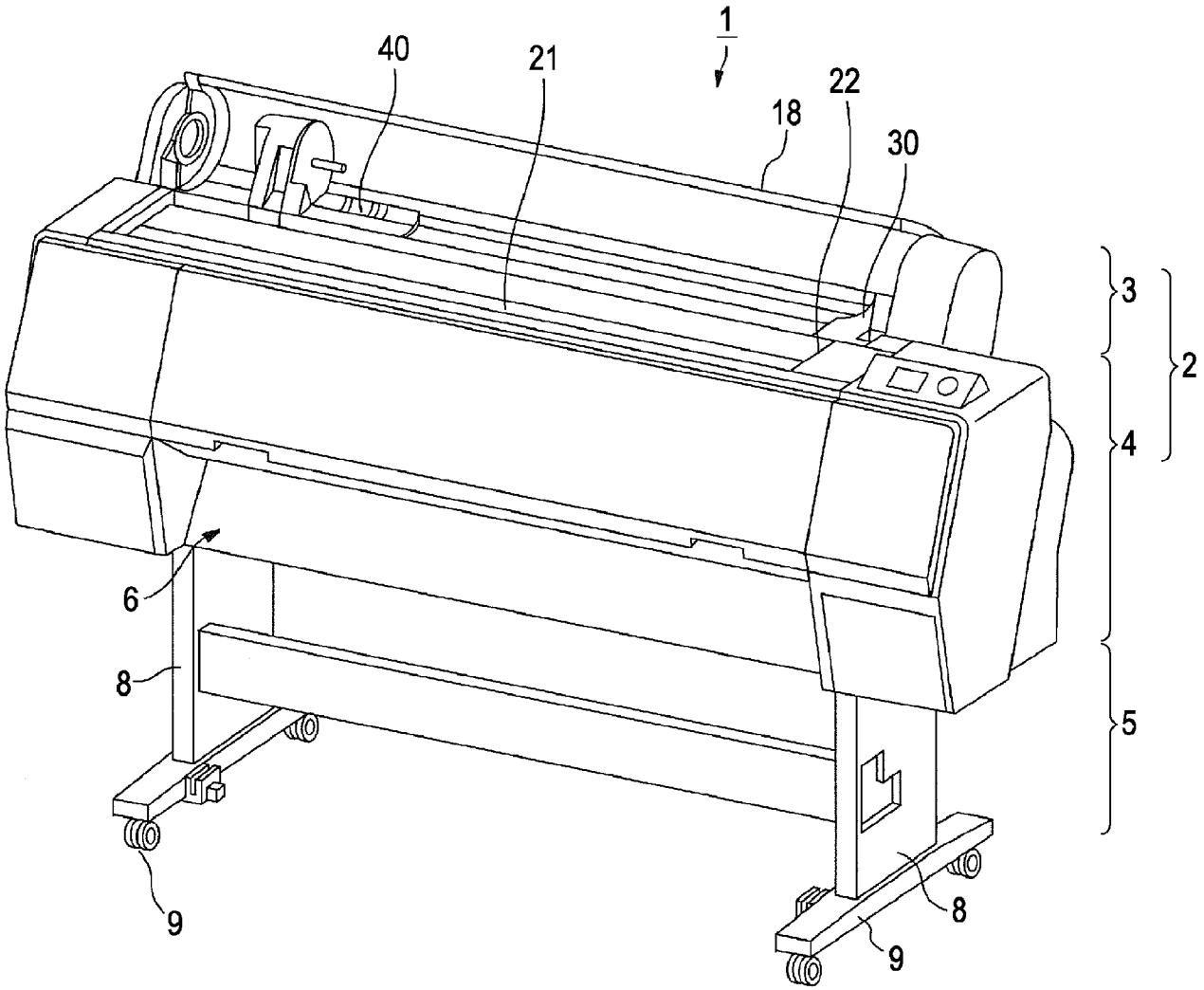
FIG. 2 is an external perspective view of the printer of the invention.
Figure 3:
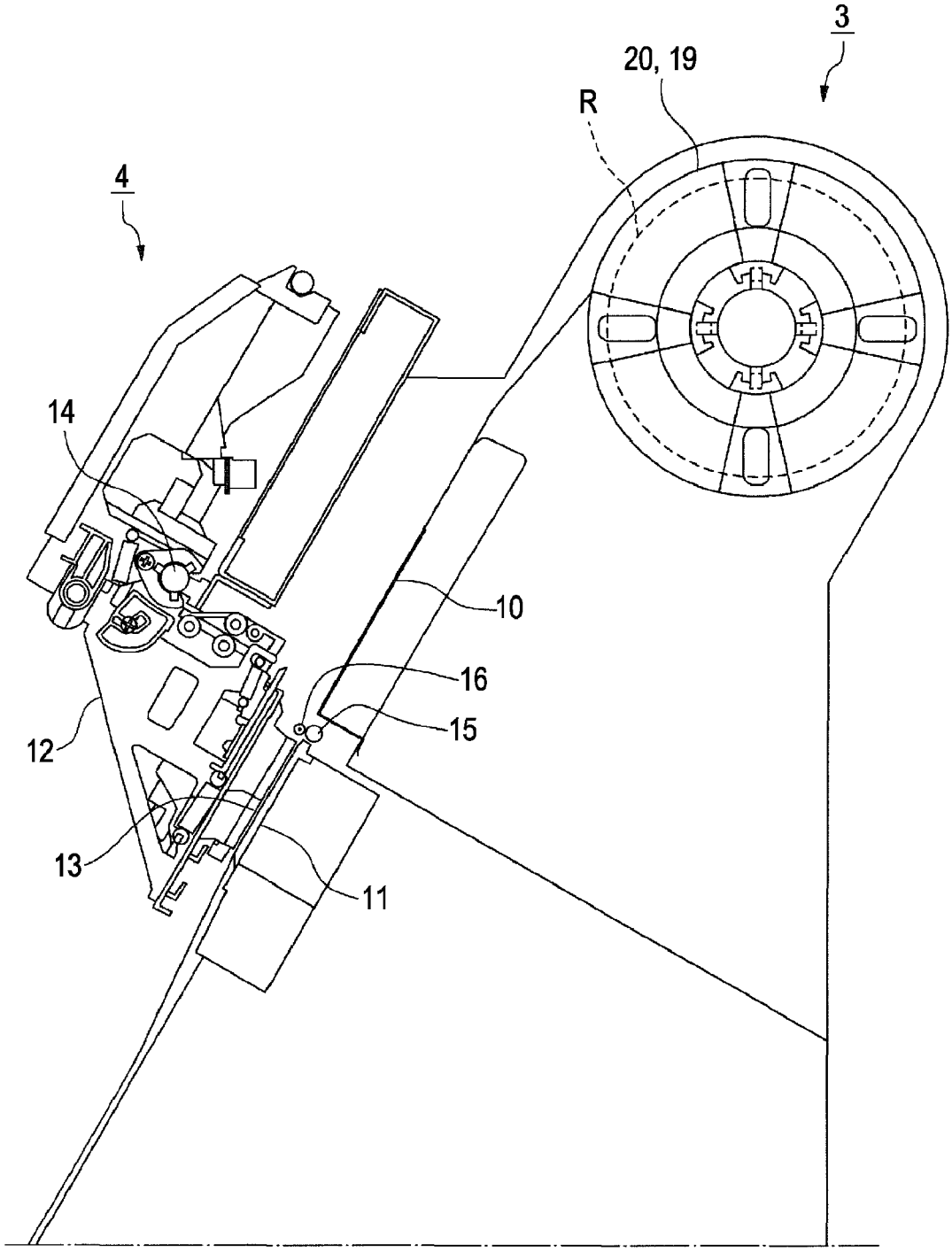
FIG. 3 is a side view of a relevant part of the printer of the invention.
Figure 4:
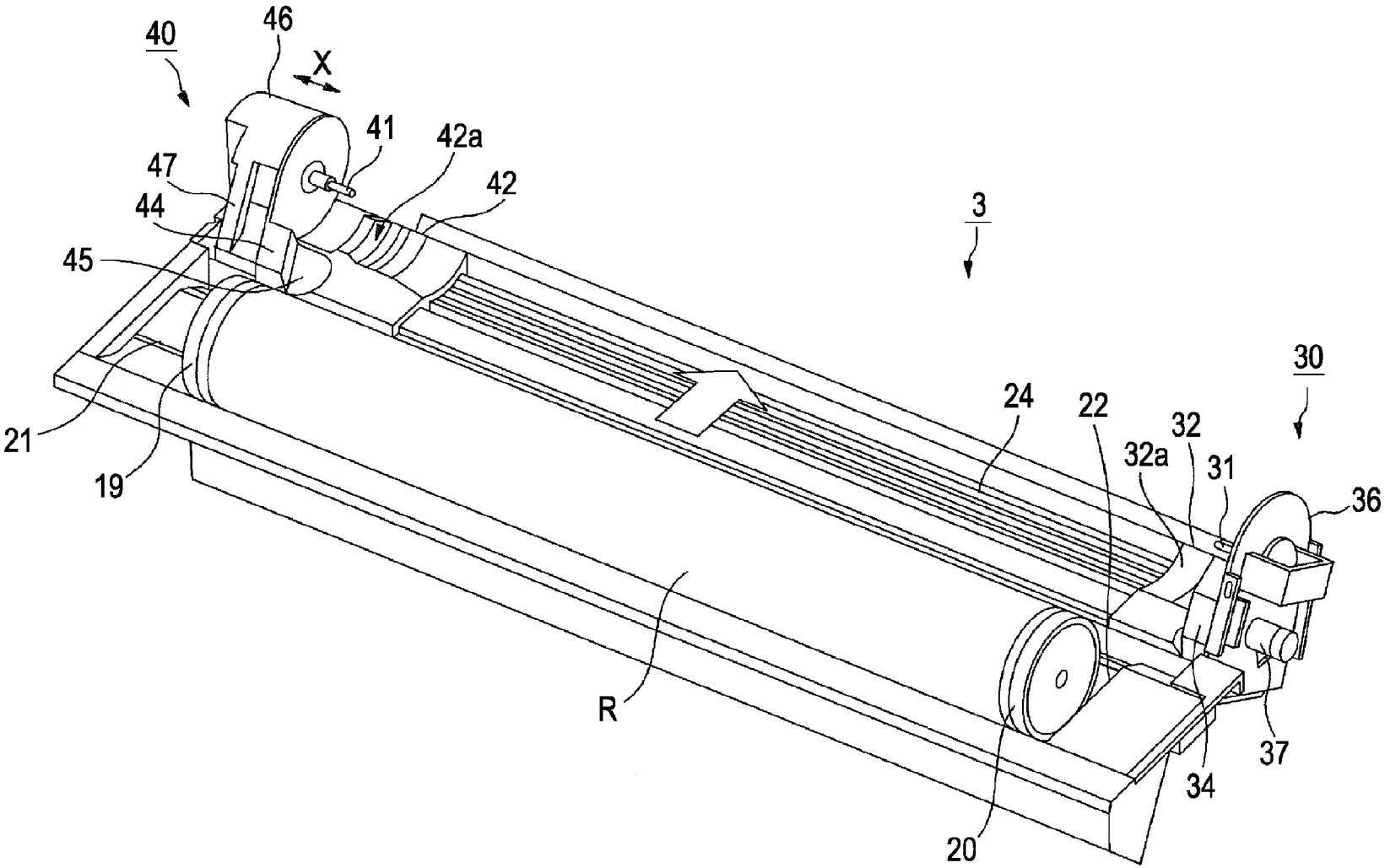
FIG. 4 is a perspective view of a rolled-sheet supply portion.
Figure 5:
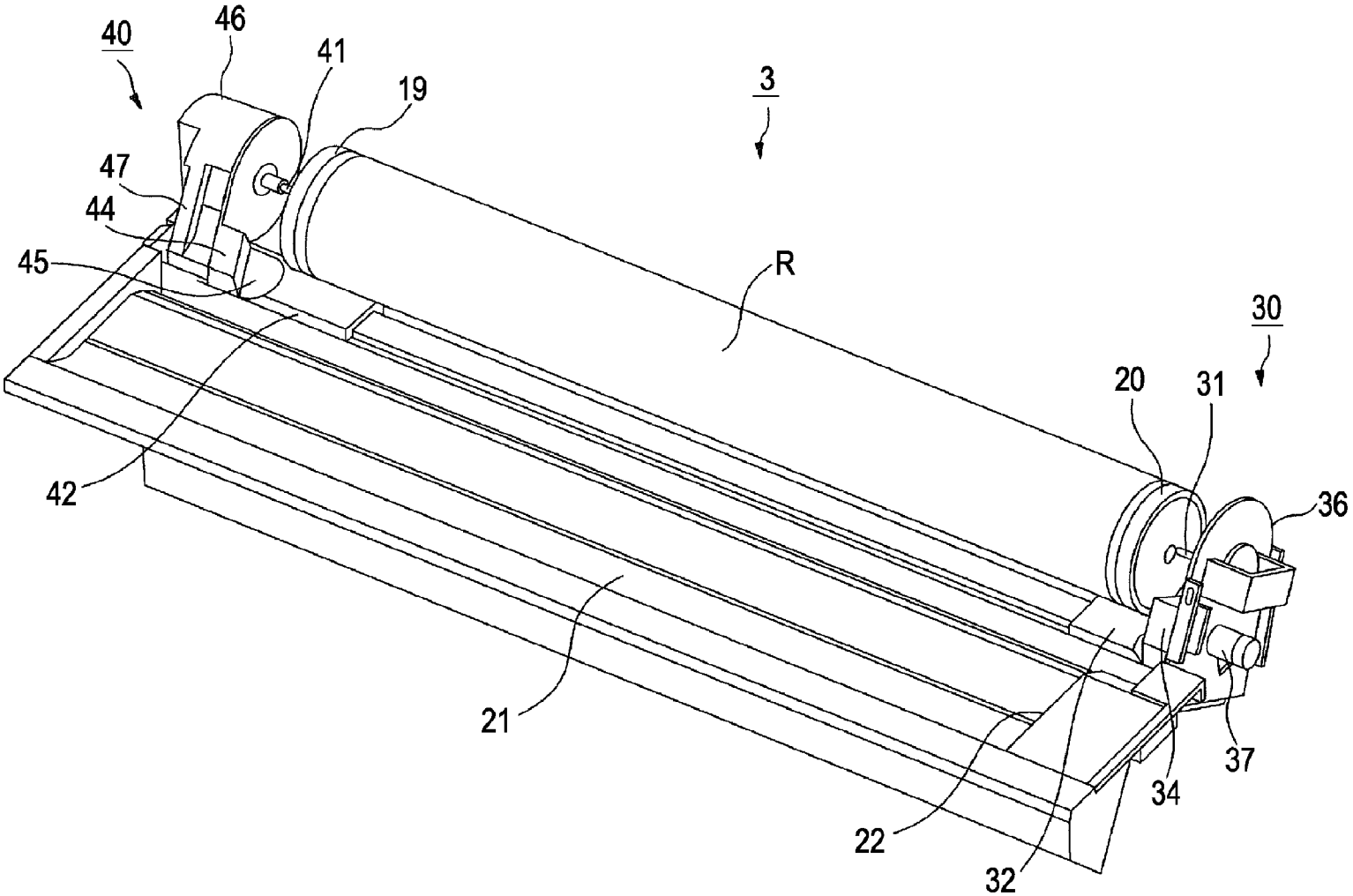
FIG. 5 is a perspective view of the rolled-sheet supply portion.
Figure 6:
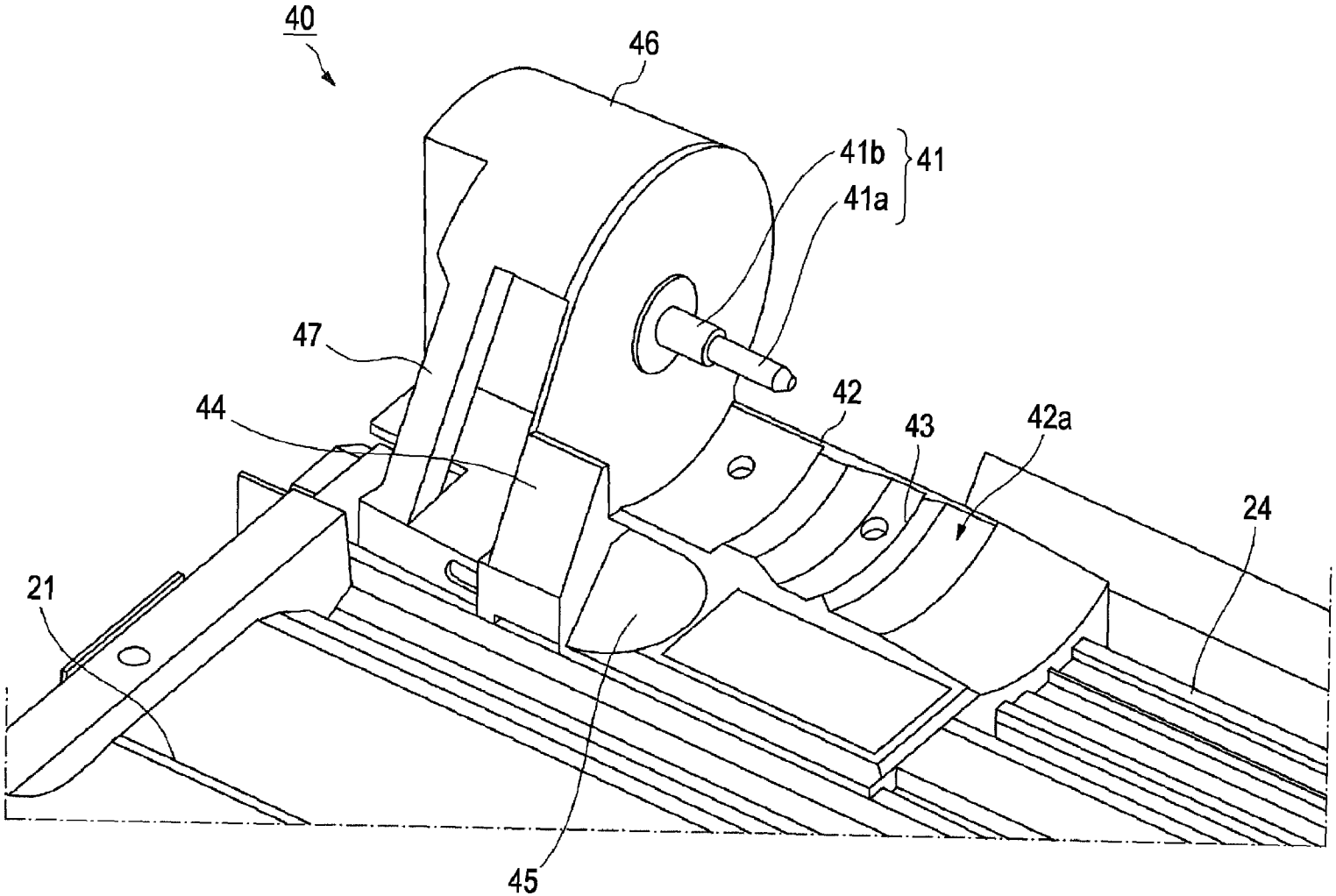
FIG. 6 is a perspective view of a movable-side holder.
Figure 7A:
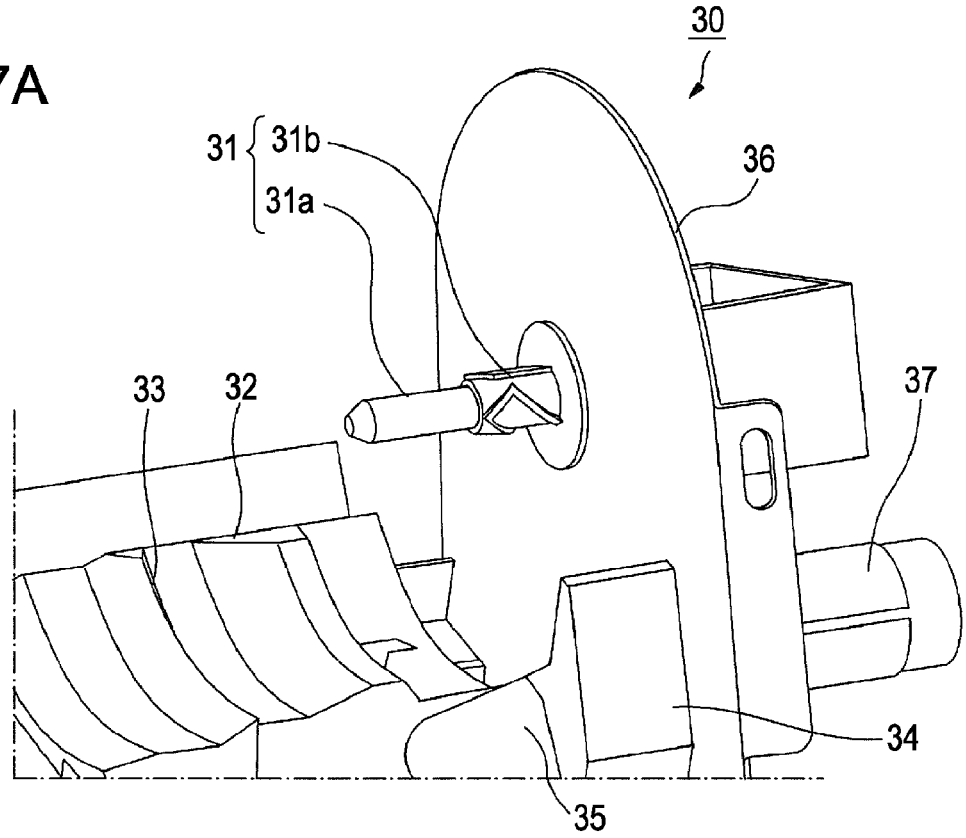
FIGS. 7A and 7B are a perspective view of a fixed-side holder and an enlarged view of a relevant part of the fixed-side holder, respectively.
Figure 7B:
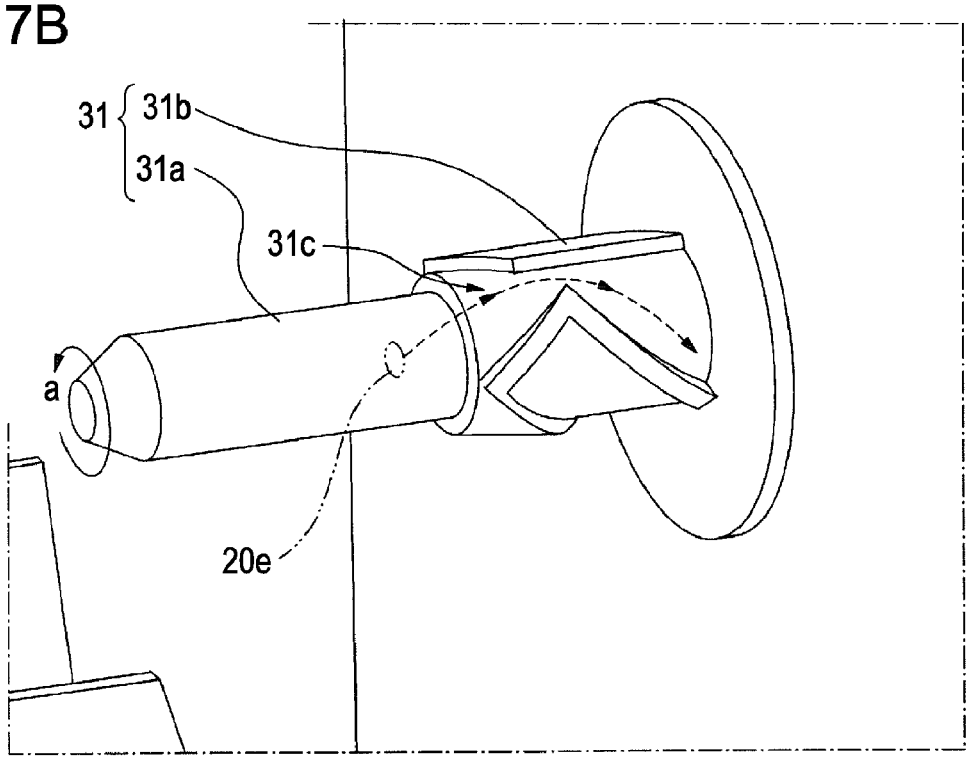
Figure 10:
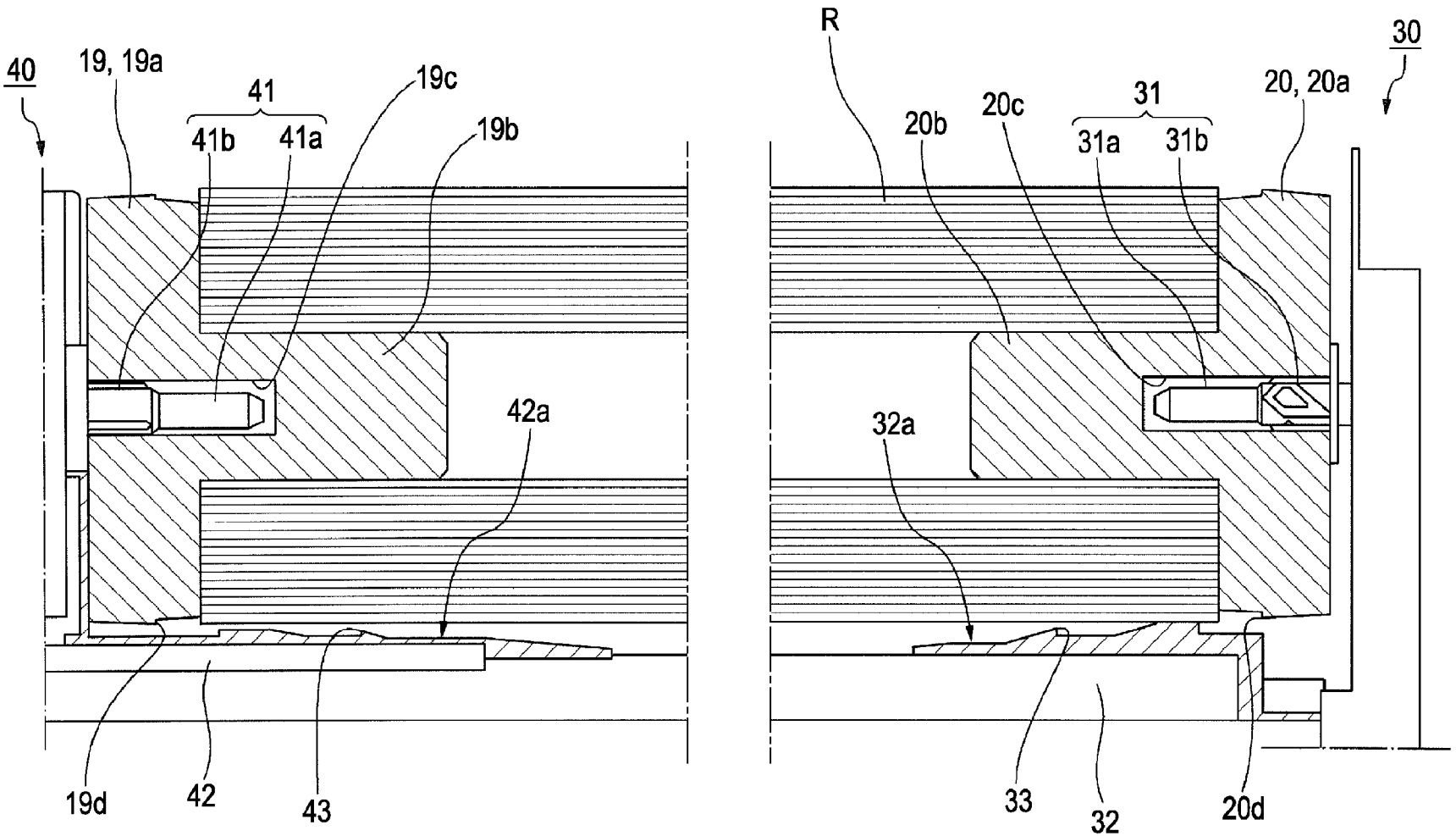
FIG. 10 is a transverse cross-section of the rolled-sheet supply portion.
Figure 11:
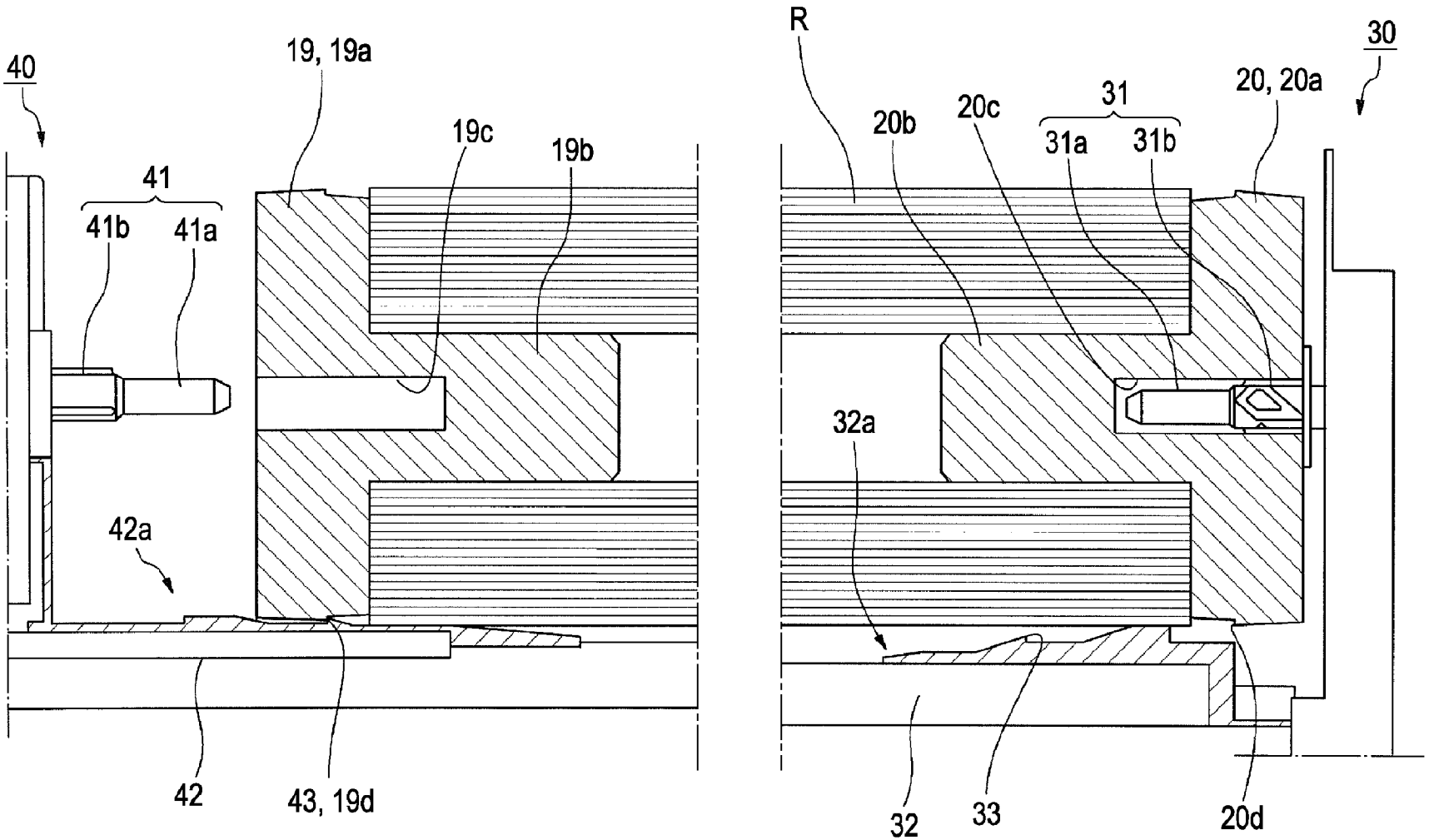
FIG. 11 is a transverse cross-section of the rolled-sheet supply portion.
Figure 12:
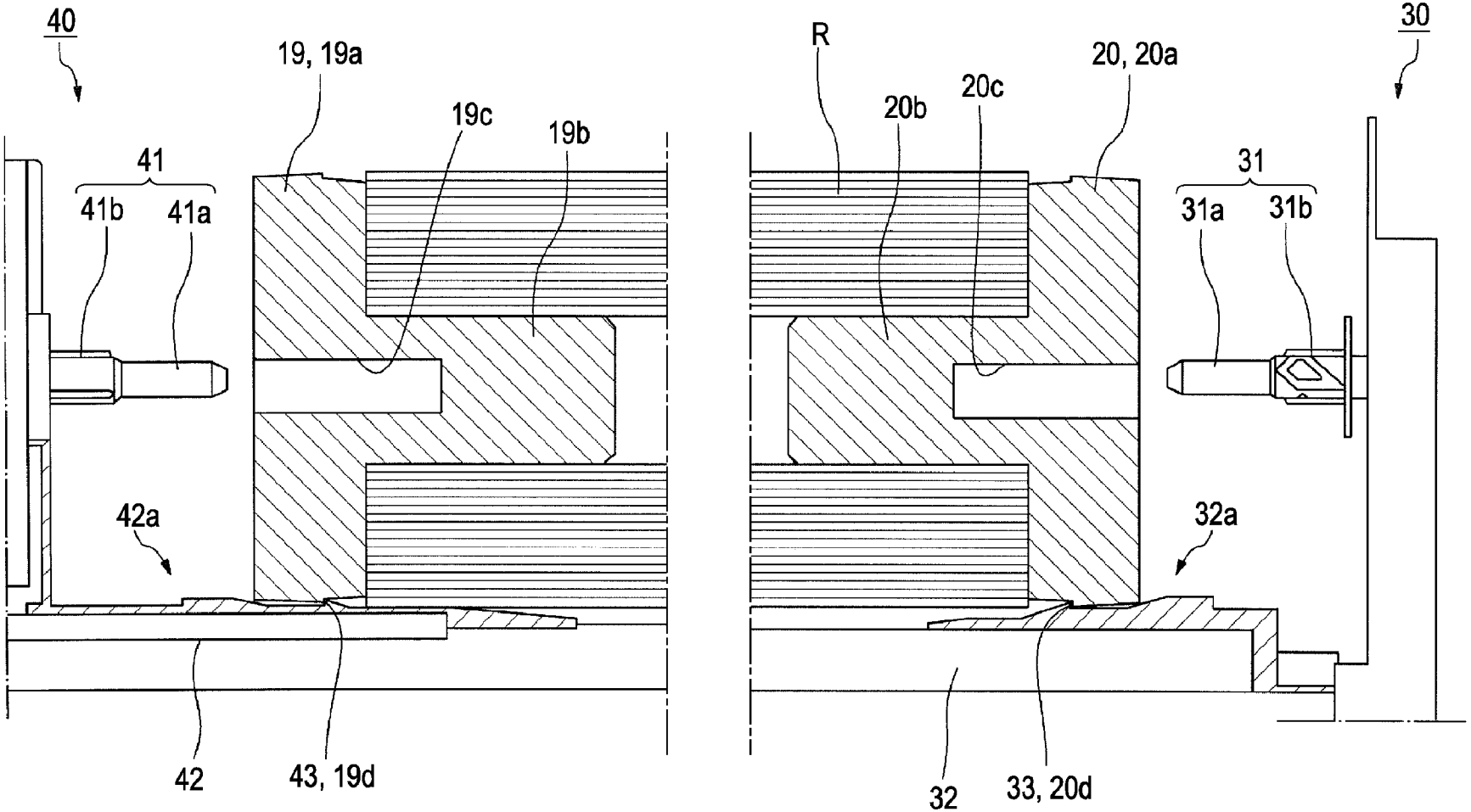
FIG. 12 is a transverse cross-section of the rolled-sheet supply portion.
Figure 13:
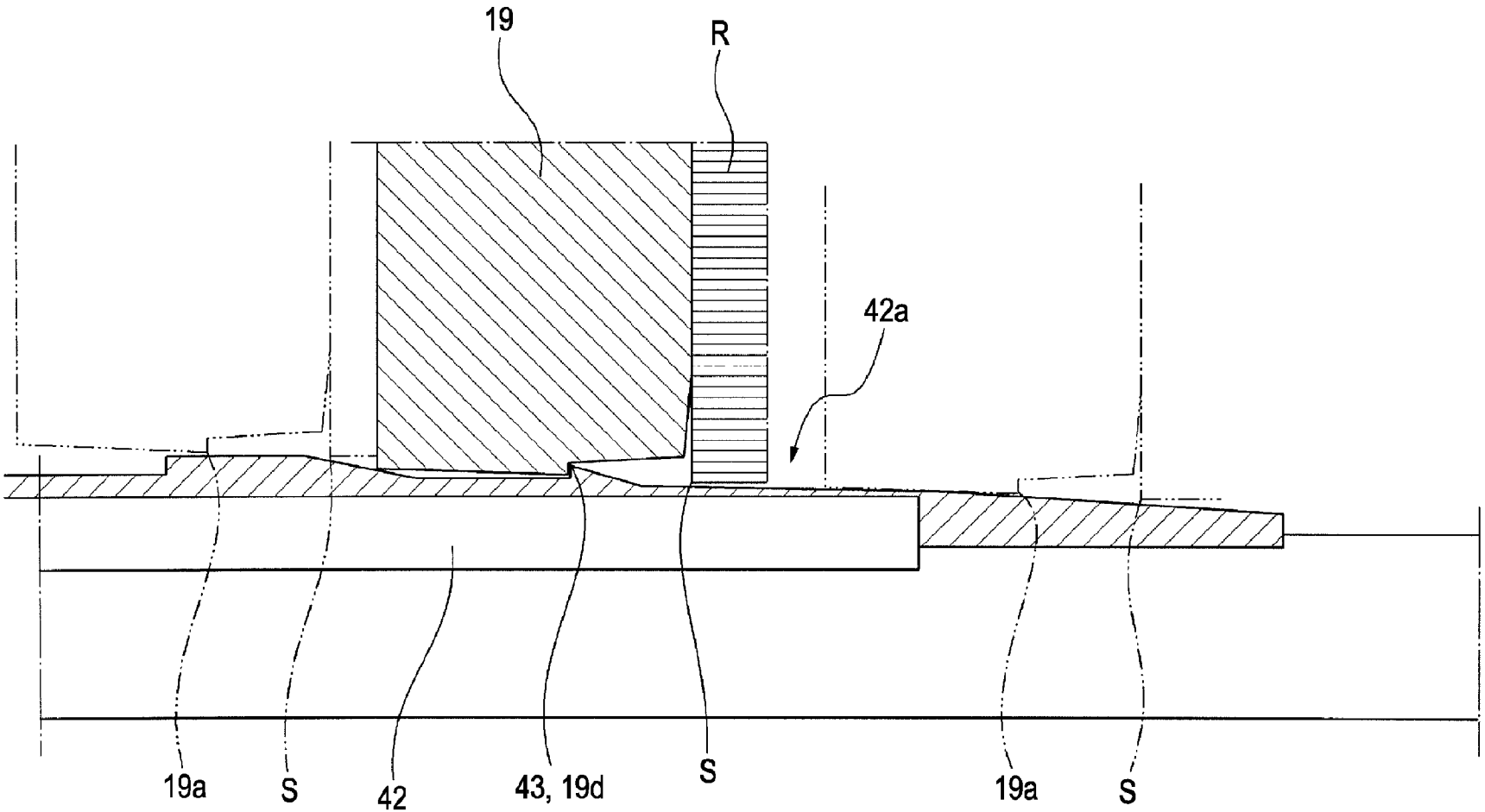
FIG. 13 is an enlarged transverse cross-section of a relevant part of the movable-side holder.
Figure 14:
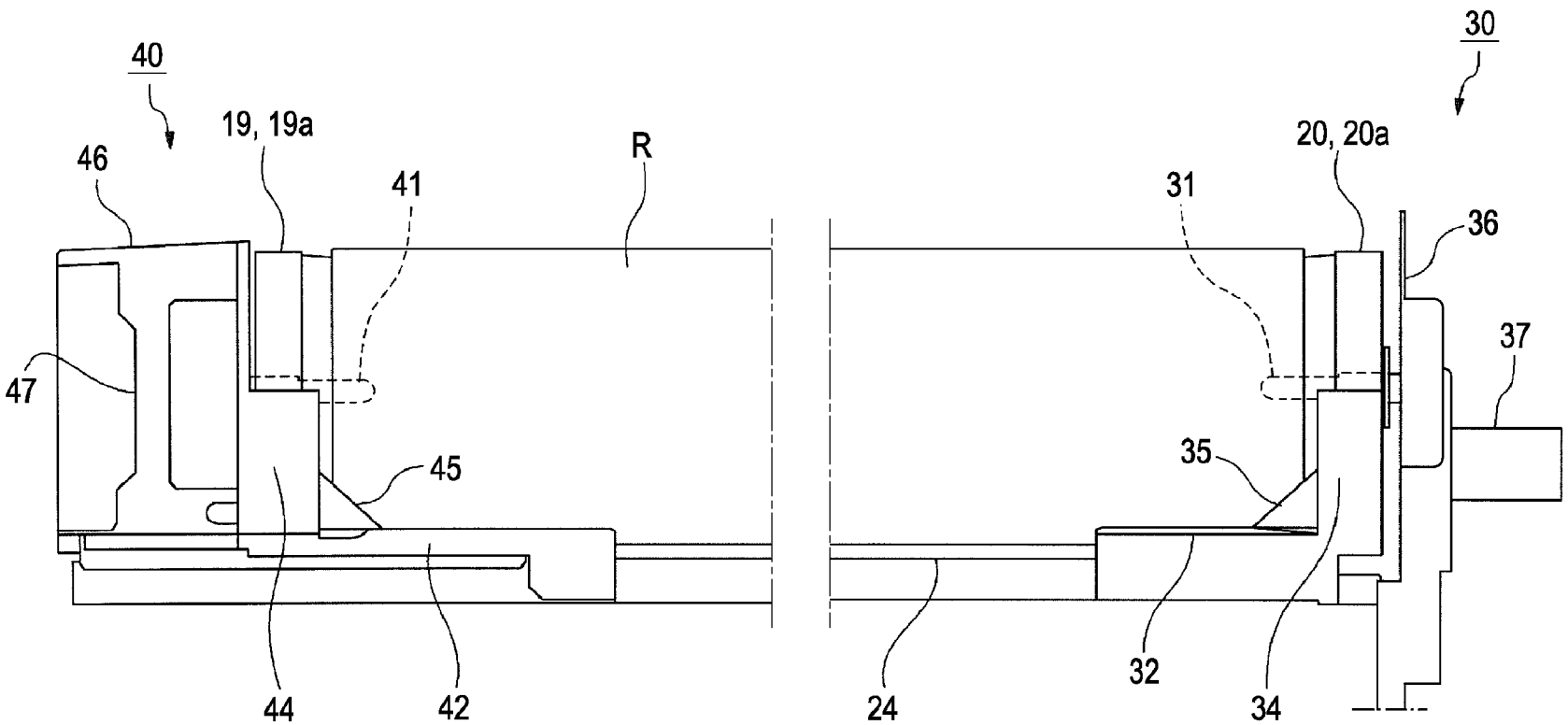
FIG. 14 is a front view of the rolled-sheet supply portion.

Embodiments of the invention will be described below with reference to the drawings. FIGS. 1 and 2 are external perspective views of an ink jet printer (hereinafter, "printer") 1, which is a recording apparatus according to an embodiment of the invention. FIG. 3 is a side view of a relevant part. FIGS. 4 and 5 are perspective views of a rolled-sheet supply portion. FIG. 6 is a perspective view of a movable-side holder. FIG. 7A is a perspective view of a fixed-side holder, and FIG. 7B is an enlarged view of a relevant part of the same. FIGS. 8A and 8B are plan views of the movable-side holder. FIG. 9 is a plan view of the movable-side holder, showing the function of a guiding projection. FIGS. 10 to 12 are transverse cross-sections of a rolled-sheet supply portion. FIG. 13 is an enlarged transverse cross-section of a relevant part of the movable-side holder. FIG. 14 is a front view of the rolled-sheet supply portion.

Overall Structure of Printer 1

Referring to FIGS. 1 to 3, the structure of a printer 1 is schematically described. The printer 1 is a large printer capable of recording on a rolled sheet P, which serves as a recording medium, having a large width such as, A0 or B0 (JIS standard). The printer 1 includes a main body 2 having a rolled-sheet supply portion 3 and a recording execution portion 4, and a main body support portion 5.

The main body 2 is provided on the main body support portion 5 having bases 9 and legs 8 provided upright on the bases 9, and has a discharge port 6 through which the recorded rolled sheet P is discharged diagonally downward. A stacker (not shown) is positioned below the discharge port 6. The recorded rolled sheet P is discharged downward from the discharge port 6 and is received by the stacker.

The rolled-sheet supply portion 3 includes a roll R around which the rolled sheet P is wound and an openable cover 18 inside which the roll R is set. The rolled sheet P drawn from the roll R is supplied diagonally downward to the recording execution portion 4 at which recording is executed.

In FIG. 3, the reference numerals 20 (19) denote below-described flanges to be attached to ends of the roll R. The roll R is supported by the rolled-sheet supply portion 3 through these flanges. When the rolled sheet is to be supplied, a below-described driving mechanism of the rolled-sheet supply portion 3 rotates the roll R. As a result, the rolled sheet P is drawn from the roll R and guided toward the downstream side by a guide member 10. The rolled-sheet supply portion 3 will be described below in detail.

The recording execution portion (recording unit) 4 includes a recording head 13, which ejects ink onto the rolled sheet P and serves as a recording mechanism, a guide member 11 arranged to face the recording head 13, and a transportation driving roller 15 and a transportation driven roller 16 that are provided on the upstream side of the recording head 13 and transport the rolled sheet P toward the downstream side.

The transportation driving roller 15 is rotated by a motor (not shown). The transportation driven roller 16 presses the rolled sheet P onto the transportation driving roller 15, while being driven. The transportation driving roller 15 and the transportation driven roller 16 precisely feed the rolled sheet P toward the downstream side.

The recording head 13 that performs recording on the rolled sheet P by ejecting ink is provided on a carriage 12. The carriage 12 is, while being guided by a guide shaft 14 extending in a scanning direction of the recording head 13, i.e., a main scanning direction (a direction perpendicular to the plane of FIG. 3), moved in the main scanning direction by a motor (not shown).

A sheet suction unit (not shown) is provided on the downstream side of the recording head 13. The sheet suction unit restrains the rolled sheet P from rising on the downstream side of the recording head 13 to prevent degradation in recording quality due to rise of the rolled sheet P.

Overall Structure of Rolled-Sheet Supply Portion 3

Referring to FIGS. 4 to 8, and other drawings if necessary, the overall structure of the rolled-sheet supply portion 3 is described. As shown in FIGS. 4 and 5, the rolled-sheet supply portion 3 includes a movable-side holder 40, which serves as a first holder, a fixed-side holder 30, which serves as a second holder, and a temporary placing portion 21, on which the roll R is temporarily placed.

The temporary placing portion 21 is a place on which the roll R is temporarily placed before being set in the fixed-side holder 30 and the movable-side holder 40. As mentioned above, because the printer 1 is a large printer capable of recording on the rolled sheet P having a large width such as A0 or B0 (JIS standard), the roll R can be very heavy.

By providing the temporary placing portion 21 in front of the fixed-side holder 30 and the movable-side holder 40, the roll R does not have to be directly moved from a low position, such as the floor, to a position where the roll R is supported by the fixed-side holder 30 and the movable-side holder 40, i.e., the back of the apparatus. Thus, the workload associated with setting of the roll R can be reduced.

Then, a fixed-side flange 20, which serves as a second flange, is attached to the end of the roll R on the fixed-side holder 30 side and a movable-side flange 19, which serves as a first flange, is attached to the end of the roll R on the movable-side holder 40 side.

FIGS. 11 to 13 each show the transverse cross-section of the flanges. For example, the movable-side flange 19 includes a collar portion 19*a* having an outside diameter substantially equal to or larger than the maximum outside diameter of the roll R, a projection 19*b* to be inserted into one of the shaft holes of the roll R, and a shaft hole 19*c* which receives a below-described driven shaft 41, which serves as a first shaft. Similarly, the fixed-side flange 20 includes a collar portion 20*a*, a projection 20*b*, and a shaft hole 20*c*.

Referring back to FIGS. 4 and 5, in the temporary placing portion 21, a positioning guide 22 is provided near the fixed-side flange 20. By bringing the fixed-side flange 20 into contact with the positioning guide 22, in other words, by placing the roll R at the right end, the reference position of the roll R (position in a direction perpendicular to the rotation axis direction) at the time of moving the roll R from the temporary placing portion 21 to a settable position is determined. The term "settable position" of the roll R refers to a support position where the roll R is supported by a below-described flange-support surface 42*a* of the movable-side holder 40 and a below-described flange-support surface 32*a* of the fixed-side holder 30 (FIG. 12 shows this state).

As shown in FIGS. 4 and 5, by rolling the roll R to the back of the apparatus, the heavy roll R can be easily moved to the settable position without being lifted.

The movable-side holder 40 and the fixed-side holder 30 have a movable-side flange receiver 42 and a fixed-side flange receiver 32, respectively. The movable-side flange receiver 42 has the flange-support surface 42*a* that is in contact with the outer periphery of the movable-side flange 19 (the collar portion 19*a*) to support the movable-side flange 19. The fixed-side flange receiver 32 has the flange-support surface 32*a* that is in contact with the outer periphery (collar portion 20*a*) of the fixed-side flange 20 to support the fixed-side flange 20.

The roll R rolled from the temporary placing portion 21 is temporarily in a settable state, in which the roll R is temporarily supported by the movable-side flange receiver 42 and the fixed-side flange receiver 32 (the state shown in FIG. 12), before it is in a set state (a state shown in FIG. 10, in which the driven shaft 41 fits into the shaft hole 19*c* and the driving shaft 31 fits into the shaft hole 20*c*). The shape of the flange-support surface 42*a* of the movable-side flange receiver 42 and the shape of the flange-support surface 32*a* of the fixed-side flange receiver 32 will be described in detail below.

The movable-side holder 40 includes the movable-side flange receiver 42, a holder base 46, and the driven shaft 41. The movable-side holder 40 is slidable in the rotation axis direction of the roll R (the direction indicated by an arrow X in FIG. 4) while being guided by a guide rail 24 that extends in the rotation axis direction of the roll R.

The holder base 46 has a handle 47. The movable-side holder 40 can be easily moved by gripping the handle 47. As shown in FIG. 6, the driven shaft 41 has a small-diameter portion 41*a* on the tip side and a large-diameter portion 41*b* on the base side, and is rotatable relative to the holder base 46.

The fixed-side holder 30 includes the fixed-side flange receiver 32, a holder frame 36, and the driving shaft 31. Unlike the movable-side holder 40, the fixed-side holder 30 is fixed. As shown in FIG. 7A, the driving shaft 31 has a small-diameter portion 31*a* on the tip side and a large-diameter portion 31*b* on the base side, and is rotatable by a driving motor 37 attached to the holder frame 36.

In the settable state of the roll R, the driven shaft 41 is not fitted in the shaft hole 19*c* in the movable-side flange 19 and the driving shaft 31 is not fitted in the shaft hole 20*c* in the fixed-side flange 20. When the movable-side holder 40 is moved toward the fixed-side holder 30 in this state, the driven shaft 41 approaches the shaft hole 19*c* while the outer periphery of the movable-side flange 19 (the outer periphery of the collar portion 19*a*) comes into contact with the flange-support surface 42*a*. In addition, the driving shaft 31 approaches the shaft hole 20*c* while the outer periphery of the fixed-side flange 20 (the outer periphery of the collar portion 20*a*) comes into contact with the flange-support surface 32*a*. Finally, the driven shaft 41 is fitted in the shaft hole 19*c* and the driving shaft 31 is fitted in the shaft hole 20*c*, and thus, the roll R is set (the state shown in FIG. 10).

A boss (denoted by reference numeral 20*e* in FIG. 7B) is provided inside the shaft hole 20*c* in the fixed-side flange 20 supported by the fixed-side holder 30. A spiral guide groove 31*c* for guiding the boss 20*e* to a guide position (a position closest to the base of the large-diameter portion 31*b*) is formed on the large-diameter portion 31*b* of the driving shaft 31.

Thus, when the driving shaft 31, while being fitted in the shaft hole 20*c* in the fixed-side flange 20, is rotated reversely (in a direction indicated by the arrow a in FIG. 7B), the boss 20*e* is guided to the base of the large-diameter portion 31*b*, as indicated by the dashed-line arrow. Thus, the fixed-side flange 20 (i.e., the roll R) is positioned at the reference position. A flange guide mechanism having the boss 20*e* and the guide groove 31*c* regulates the position of the roll R in the width direction to provide an adequate recording result, in which the margin is constant.

Mechanism for Preventing Flange from Colliding with Shaft

Figure 8:
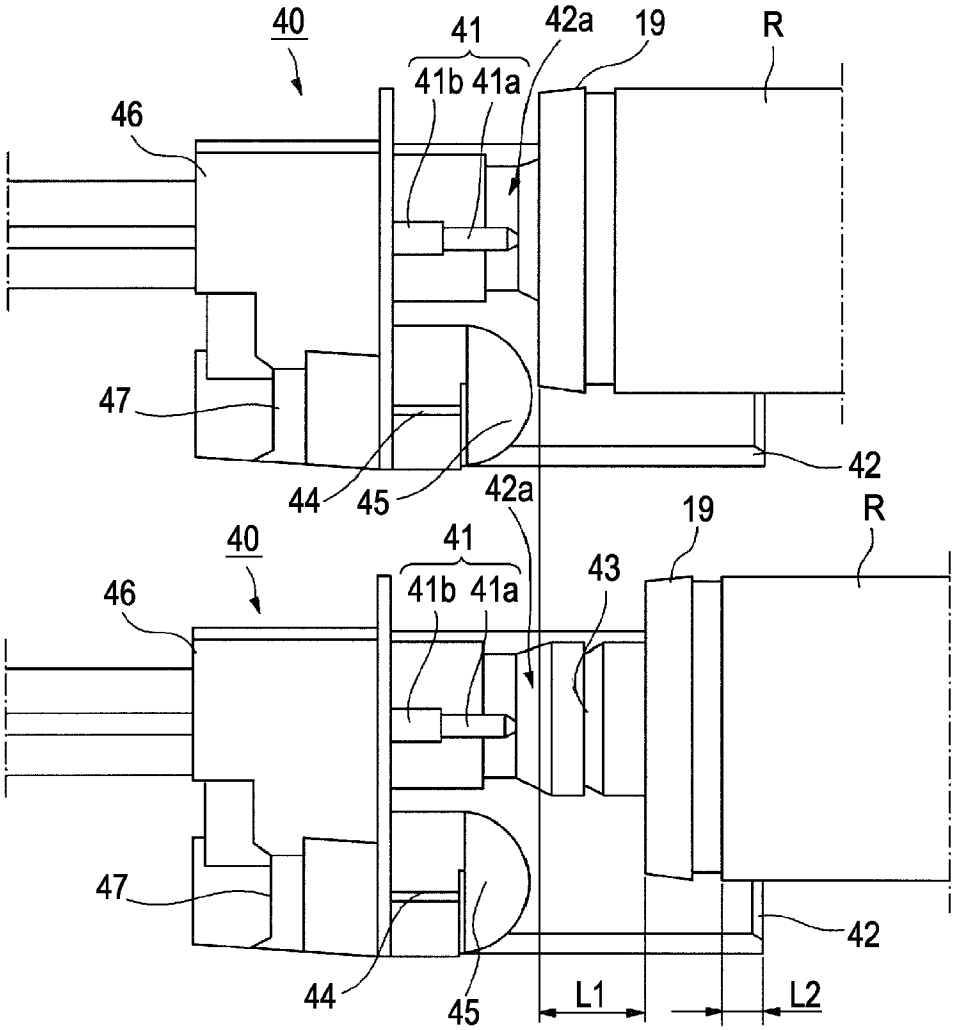
FIG. 8 is a plan view of the movable-side holder.
Figure 9:
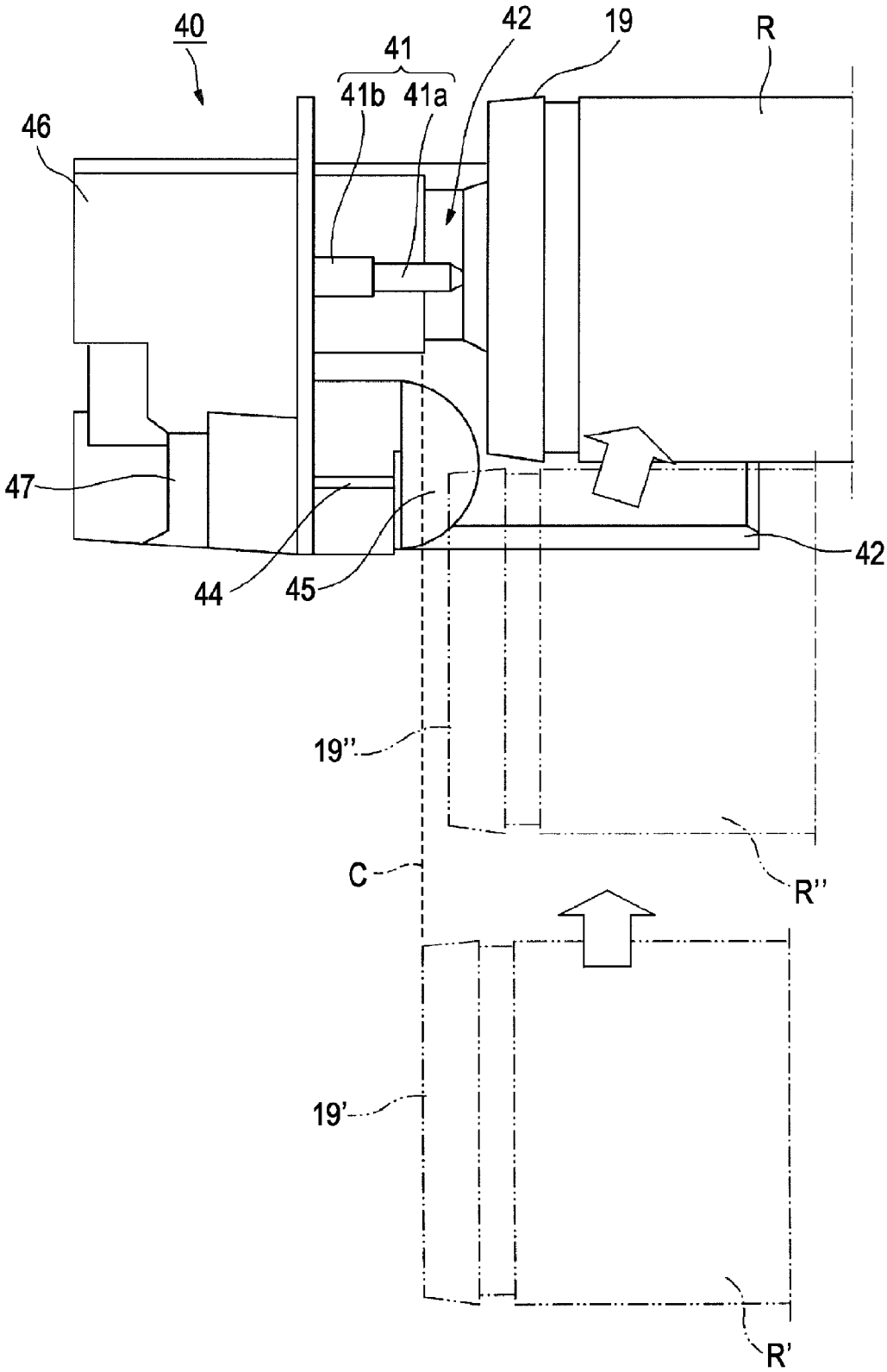
FIG. 9 is a plan view of the movable-side holder, showing the function of a guiding projection.

Referring to FIGS. 8, 9 and other drawings, a mechanism for preventing the flanges (the movable-side flange 19 and the fixed-side flange 20) from colliding with the shafts (the driven shaft 41 and the driving shaft 31) will be described.

As described above, when the roll R is rolled from the temporary placing portion 21 to the settable position, the position of the roll R in the rotation axis direction is controlled by the positioning guide 22. Thus, in this embodiment, the positional relationship between the fixed-side holder 30 and the fixed-side flange 20 in the rotation axis direction of the roll R is relatively constant.

On the other hand, because the movable-side holder 40 is movable in the rotation axis direction of the roll R, the positional relationship between the movable-side holder 40 and the movable-side flange 19 at the time of rolling the roll R from the temporary placing portion 21 to the settable position tends to vary.

Therefore, it is preferable that the positional tolerance of the movable-side holder 40 at the time of rolling the roll R from the temporary placing portion 21 to the settable position be provided as much as possible. Accordingly, in this embodiment, the positional tolerance of the flange-support surface 42*a* with respect to the movable-side flange 19 (the length denoted by reference numeral L1 in FIG. 8) is 50 mm or more.

When the movable-side holder 40 is moved toward the fixed-side holder 30, if the end of the roll R is displaced from the flange-support surface 42*a*, the end of the flange-support surface 42*a* may collide with the outer peripheral corner of the roll R and damage the sheet. Therefore, it is also preferable that the positional tolerance of the flange-support surface 42*a* with respect to the outer peripheral corner of the roll R (the length denoted by reference numeral L2 in FIG. 8) be provided as much as possible. In this embodiment, a positional tolerance of 20 mm or more is secured.

When the roll R is rolled from the temporary placing portion 21 to the settable position, if the movable-side holder 40 is closer to the fixed-side holder 30 than necessary, the movable-side flange 19 may collide with the driven shaft 41. In particular, in the case of a very heavy roll, if the movable-side flange 19 collides with the driven shaft 41, the driven shaft 41 may be deformed or damaged. If deformed or damaged, the driven shaft 41 cannot adequately support the roll R.

In this embodiment, a guiding projection 45, which serves as a projection member, is arranged in a path in which the movable flange 19 collides with the driven shaft 41 when the roll R is moved from the temporary placing portion 21 to the settable position.

In the movable-side flange receiver 42, the guiding projection 45 is arranged in front of the driven shaft 41. As shown in FIG. 14, as viewed from the front, the guiding projection 45 is inclined downward toward the fixed-side holder 30, and the end of the inclined guiding projection 45 is positioned slightly closer to the fixed-side holder 30 than the tip of the driven shaft 41.

FIG. 9 shows a case where the movable-side flange 19 collides with the driven shaft 41 when the roll R is rolled from the temporary placing portion 21 to the settable position. As indicated by a dashed line c, the end surface of the movable-side flange 19 is closer to the base than the tip of the driven shaft 41. Thus, if the roll R is rolled straight in this state, the movable-side flange 19 collides with the driven shaft 41.

However, because the guiding projection 45 is arranged in the path in which the movable flange 19 collides with the driven shaft 41, the guiding projection 45 prevents the movable-side flange 19 from colliding with the driven shaft 41. Thus, the driven shaft 41 can be prevented from being deformed or damaged to become unable to adequately support the roll R.

Furthermore, the guiding projection 45 not only prevents the collision the movable-side flange 19 with the driven shaft 41, but also guides the movable-side flange 19 to a proper position where the movable-side flange 19 does not interfere with the driven shaft 41, as indicated by reference numerals 19', 19", and 19 in FIG. 9. Accordingly, the roll R can be placed at a proper position without requiring a user to perform a special operation. That is, the inclined guiding projection 45 constitutes a guide mechanism that guides the roll R to the proper position.

In addition, even if the rolled sheet P is drawn from the roll R when the movable-side holder 40 is slid toward the fixed-side holder 30, the inclined guiding projection 45 does not collide with the rolled sheet P but lifts the rolled sheet P from below. Thus, the guiding projection 45 does not damage the rolled sheet P drawn from the roll R.

A guiding projection 35 that serves a similar function to the guiding projection 45 is provided on the fixed-side holder 30. Thus, even when the fixed-side flange 20 moves toward the driving shaft 31, the guiding projection 35 prevents them from colliding with each other and guides the roll R to the proper position.

In the above-described embodiment, the flanges (the movable-side flange 19 and the fixed-side flange 20) are attached to both ends of the roll R. However, the same advantage can of course be obtained if the roll R with no flanges is rolled to the settable position.

Mechanism for Engaging Flange with Flange Receiver

Referring to FIGS. 10 to 14 and other drawings, mechanisms for engaging the flanges (the movable-side flange 19 and the fixed-side flange 20) with the flange receivers (the movable-side flange receiver 42 and the fixed-side flange receiver 32) will be described. The engaging mechanism is provided at each of the fixed-side holder 30 and the movable-side holder 40. Thus, in the following description, the engaging mechanism on the movable-side holder 40 side will be described.

The flange-support surface 42*a* formed on the top surface of the movable-side flange receiver 42 has concaves so as to conform to the outer circumferential shape of the collar portion 19*a* of the movable-side flange 19, and, as shown in FIG. 10, in a transverse cross-section, gradually rises from the distal end (the right side in FIG. 10) to the base (the left side in FIG. 10). Thus, when the movable-side holder 40 moves toward the fixed-side holder 30, the movable-side flange 19 slides over the flange-support surface 42*a* and is lifted to a position where the shaft hole 19*c* can be inserted into the driven shaft 41.

The collar portion 19*a* of the movable-side flange 19 has a step portion 19*d*, which serves as a first receiving portion, on the outer periphery. The flange-support surface 42*a* has an engaging portion 43, which serves as a first engaging portion, engagable with the step portion 19*d*.

FIG. 10 shows the roll R in a set state. In this state, the driven shaft 41 is completely inserted into the shaft hole 19*c* in the movable-side flange 19. In this state, the movable-side flange 19 (and the roll R) does not touch the flange-support surface 42*a*. The fixed-side holder 30 side is also in this state.

In this state, when the movable-side holder 40 is slid away from the fixed-side holder 30 to remove the roll R, the driven shaft 41 is removed from the shaft hole 19*c*. As a result, the collar portion 19*a* of the movable-side flange 19 is supported by the flange-support surface 42*a* and the step portion 19*d* of the movable-side flange 19 engages with the engaging portion 43. Thus, if the movable-side holder 40 is further moved away from the fixed-side holder 30, the movable-side flange 19 (i.e., the roll R) moves away from the fixed-side holder 30 along with the movable-side holder 40.

In this embodiment, the reason why the driven shaft 41 is removed from the shaft hole 19*c* before the driving shaft 31 is removed from the shaft hole 20*c* is because, as described above, the flange guide mechanism for guiding the fixed-side flange 20 to the reference position is provided on the fixed-side holder 30 and the flange guide mechanism retains the roll R on the fixed-side holder 30 side.

When the movable-side holder 40 is further moved away from the fixed-side holder 30 from the state shown in FIG. 11, the driving shaft 31 is removed from the shaft hole 20*c*. As a result, the step portion 20*d* of the fixed-side flange 20, which serves as a second receiving portion, engages with the engaging portion 33, which serves as the second engaging portion. Thus, movement of the roll R (and the movable-side holder 40) toward the movable-side holder 40 is restricted.

As described above, by moving the movable-side holder 40 away from the fixed-side holder 30, the driven shaft 41 is certainly removed from the shaft hole 19*c* and the driving shaft 31 is certainly removed from the shaft hole 20*c*. Accordingly, the roll R can be prevented from being removed without the driven shaft 41 and the driving shaft 31 being completely removed from the corresponding shaft holes and thus deforming or damaging the driven shaft 41 and the driving shaft 31.

As in this embodiment, in a structure in which the driven shaft on one side (on the movable-side holder 40 side) is removed from the corresponding shaft hole before the driving shaft on the other side (on the fixed-side holder 30 side) is removed from the corresponding shaft hole, the mechanism for engaging the flange and the flange receiver may be provided only on one side (on the movable-side holder 40 side). However, when it is not clear which of the shafts is removed first, it is preferable that the engaging mechanism be provided on each side.

When the movable-side holder 40 is to be moved toward the fixed-side holder 30 to bring the roll R from the settable state (for example, the state shown in FIG. 12) to the set state (the state shown in FIG. 10), the collar portion 19*a* of the movable-side flange 19 slides on the flange-support surface 42*a*. As shown in FIG. 13, the flange-support surface 42*a* is shaped so as not to interfere with an outer peripheral corner S of the roll R.

Thus, the flange-support surface 42*a* is prevented from touching and damaging the outer peripheral corner S (i.e., the edge of the rolled sheet) of the roll R. Similarly to the flange-support surface 42*a*, the flange-support surface 32*a* on the fixed-side holder 30 side is also shaped so as not to interfere with the outer peripheral corner of the roll R.

As shown in FIGS. 6 and 14, the movable-side flange receiver 42 has a wall portion 44 that faces the outer circumference of the movable-side flange 19 when the roll R is in a set state, and at a position adjacent to a position from which the roll is to be set. The wall portion 44 enables a user to visually recognize that the roll R is removable. Accordingly, it is possible to prevent the user from trying to remove the roll in a set state and to protect the driven shaft 41 and the driving shaft 31.

Movable-Side Holder According to Other Embodiments

Figure 15:
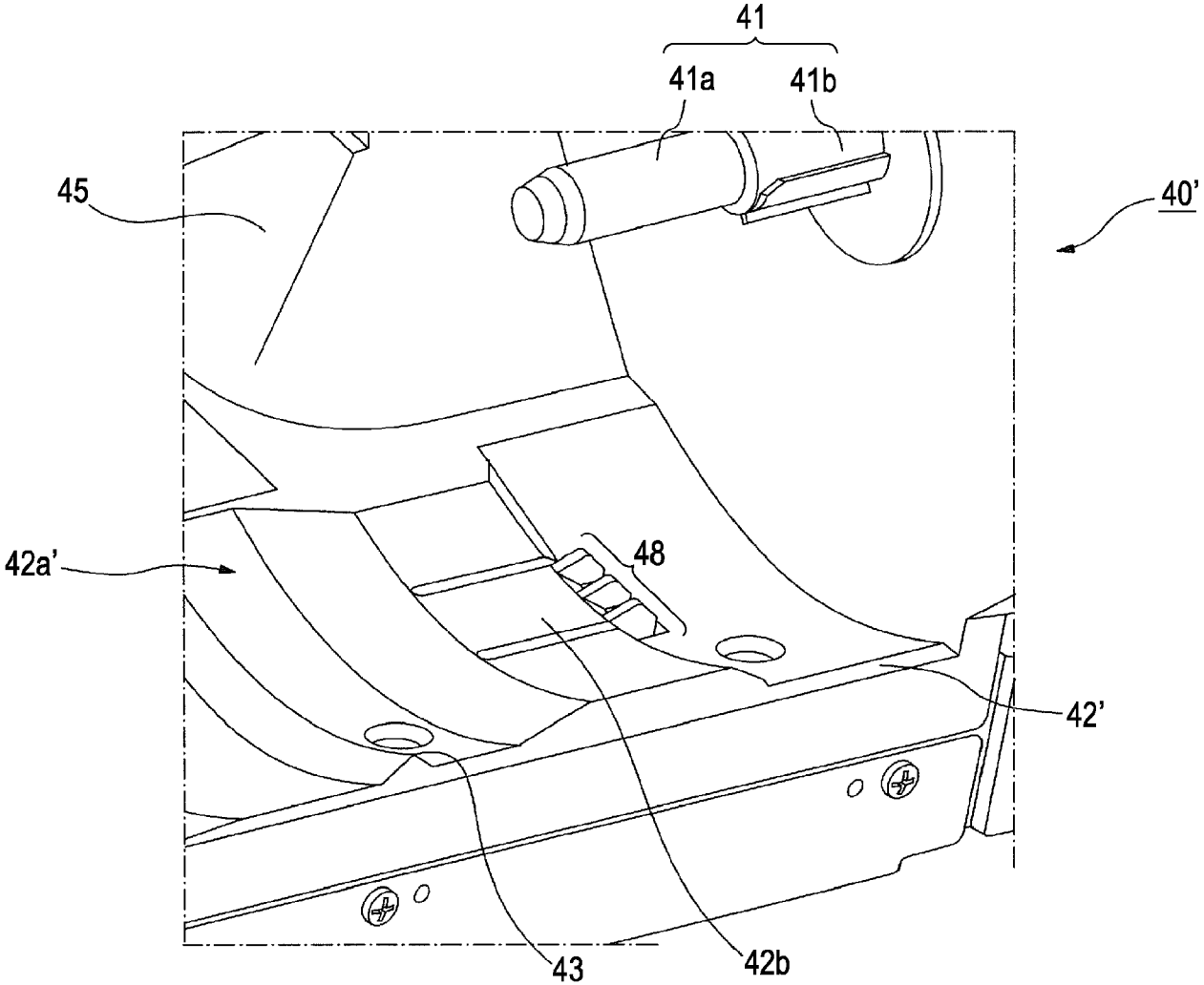
FIG. 15 is a perspective view of a movable-side holder according to another embodiment.

Referring to FIGS. 15 to 20, movable-side holders according to other embodiments will be described. FIG. 15 is a perspective view of a movable-side holder 40' (a movable-side flange receiver 42') according to another embodiment. FIGS. 16A and 16B are cross-sections of a relevant part of the movable-side holder 40'. FIGS. 17 to 20 are transverse cross-sections of the movable-side holder 40' and the fixed-side holder 30', showing changes in state during operation. In FIGS. 15 to 20, the elements that are the same as those described above are denoted by like reference numerals, and explanations thereof will be omitted.

The movable-side holder (first holder) 40' according to this embodiment is mainly different from the above-described movable-side holder 40 in a flange-support surface 42*a*'. More specifically, the movable-side holder 40' has a holder-side engaging portion 48, which serves as a shaft-removing mechanism.

The holder-side engaging portion 48 is formed at the tip (free end) of an elastic piece 42*b*, which is formed by removing a part of the movable-side flange receiver 42' made of a resin material, and is movable between a projected position (FIG. 16A) and a retracted position (FIG. 16B) by the elastic deformation of the elastic piece 42*b*.

Figure 16A:
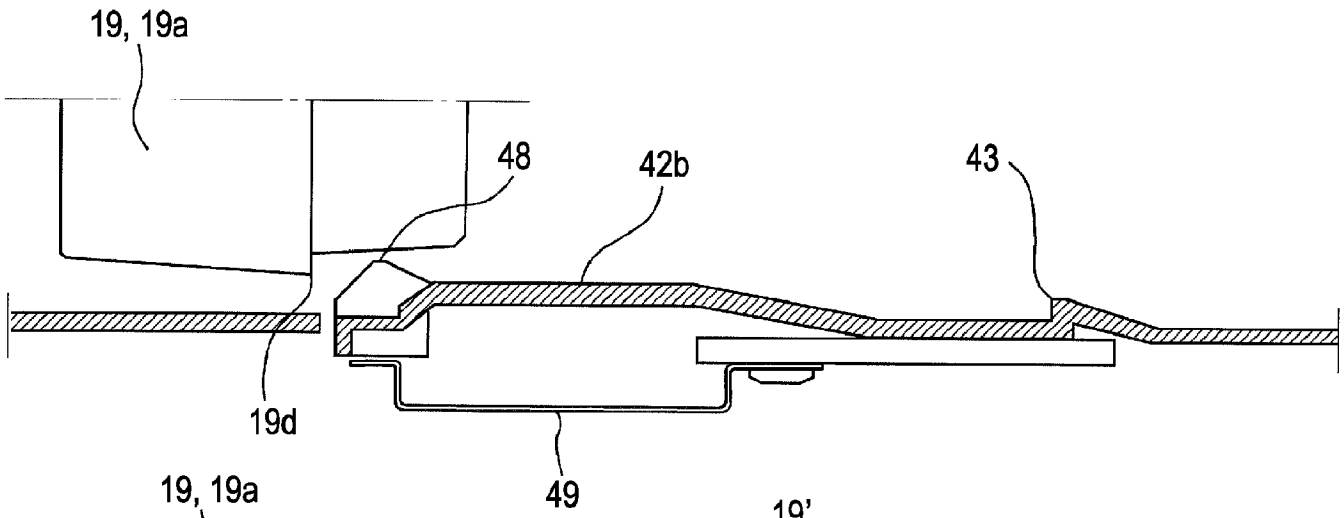
FIGS. 16A and 16B are cross-sections of a relevant part of the movable-side holder according to another embodiment.
Figure 16B:
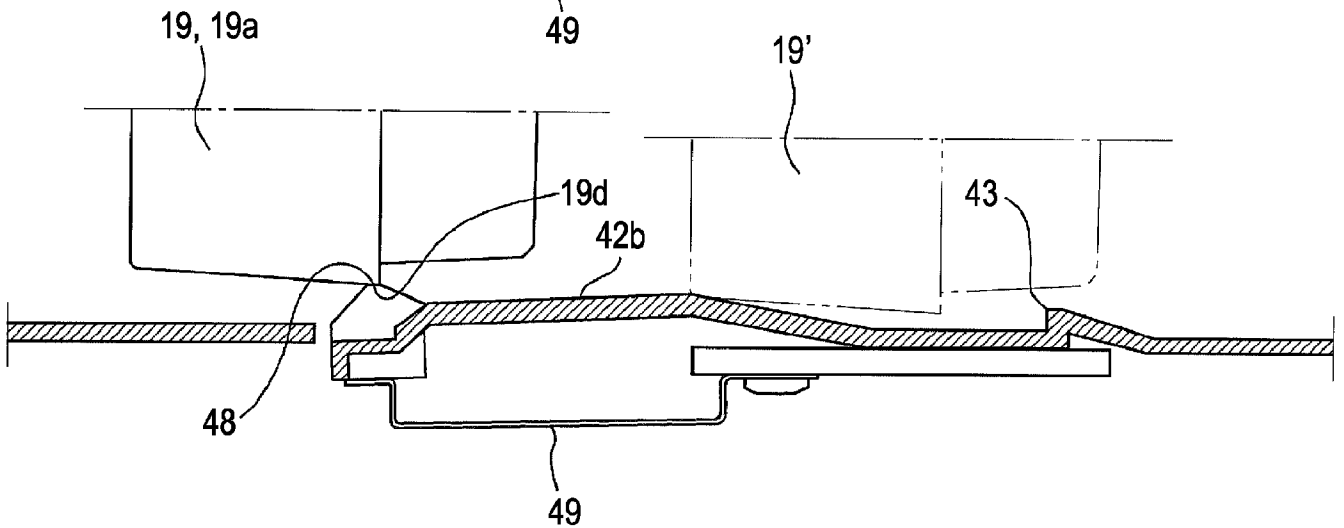

A leaf spring 49, which serves as an urging member, is disposed below the holder-side engaging portion 48. As shown in FIG. 16B, the leaf spring 49 engages with the holder-side engaging portion 48 to exert an urging force (elastic force) thereon when the holder-side engaging portion 48 moves to the retracted position.

Figure 17:
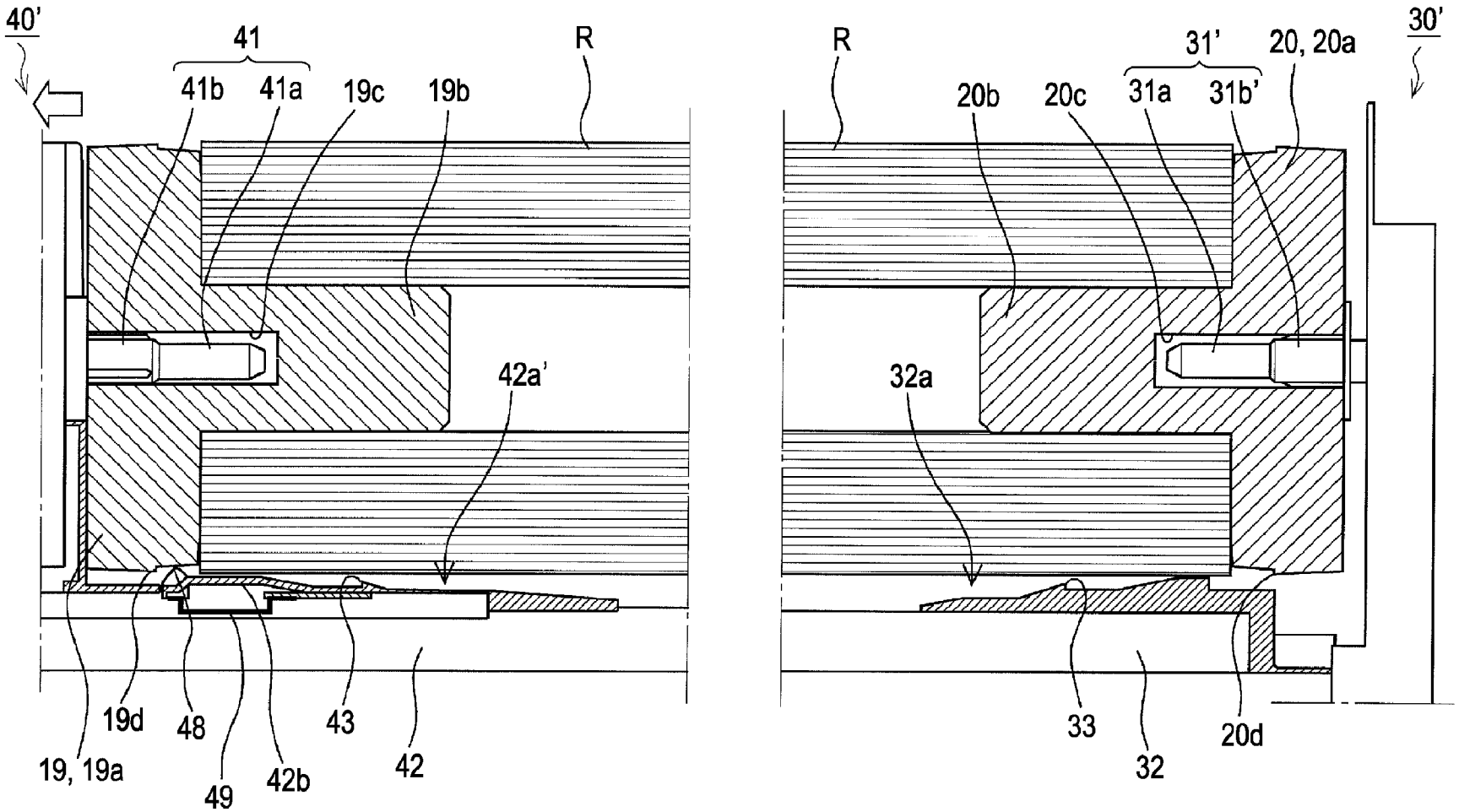
FIG. 17 is a transverse cross-section of the movable-side holder and the fixed-side holder.

Referring to FIGS. 17 to 20, the function of the holder-side engaging portion 48 will be described below. FIG. 17 shows, similarly to FIG. 10, the roll R in a set state. In this state, the driven shaft 41 is completely inserted into the shaft hole 19*c* of the movable-side flange 19 and the driving shaft 31' is completely inserted into the shaft hole 20*c* in the fixed-side flange 20. The phrase "the shaft is completely inserted into the shaft hole" refers to the relationship between the flange and the shaft in a state in which the movable-side holder 40' is moved toward the fixed-side holder 30' to a maximum extent (the movable-side holder 40' cannot move further toward the fixed-side holder 30').

Figure 18:
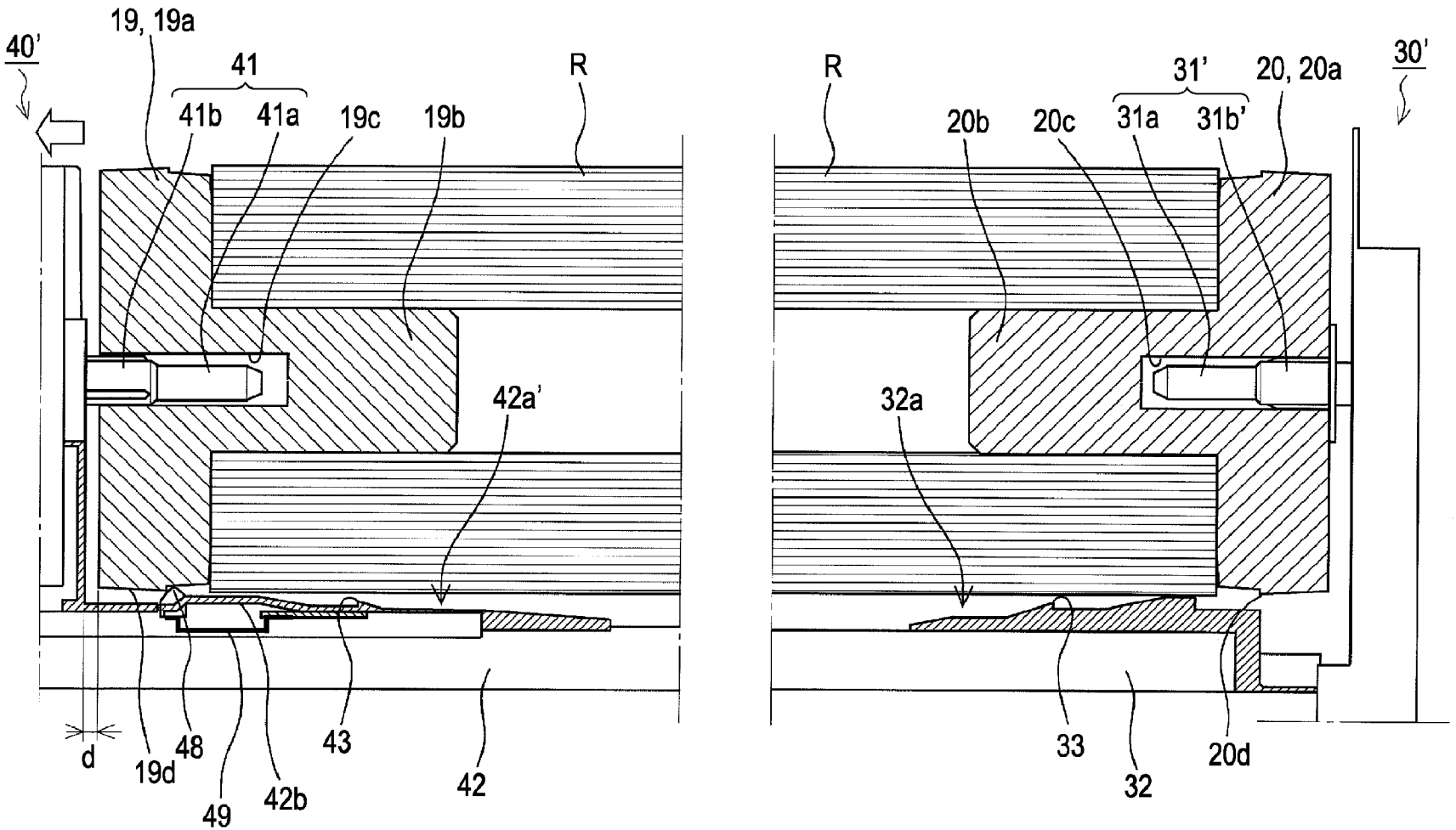
FIG. 18 is a transverse cross-section of the movable-side holder and the fixed-side holder.

In this state, when the movable-side holder 40' is to be slid away from the fixed-side holder 30' (in FIGS. 17 to 20, toward the left side) to remove the roll R, the step portion 19*d* of the movable-side flange 19, which serves as a flange-side engaging portion, engages with the holder-side engaging portion 48, as shown in FIG. 18.

The holder-side engaging portion 48 is positioned such that the step portion 19*d* engages with the holder-side engaging portion 48 before the driven shaft 41 is removed from the shaft hole 19*c* in the movable-side flange 19. In FIG. 18, a distance d represents the distance between the movable-side flange 19 and the movable-side holder 40' when the step portion 19*d* engages with the holder-side engaging portion 48.

Figure 19:
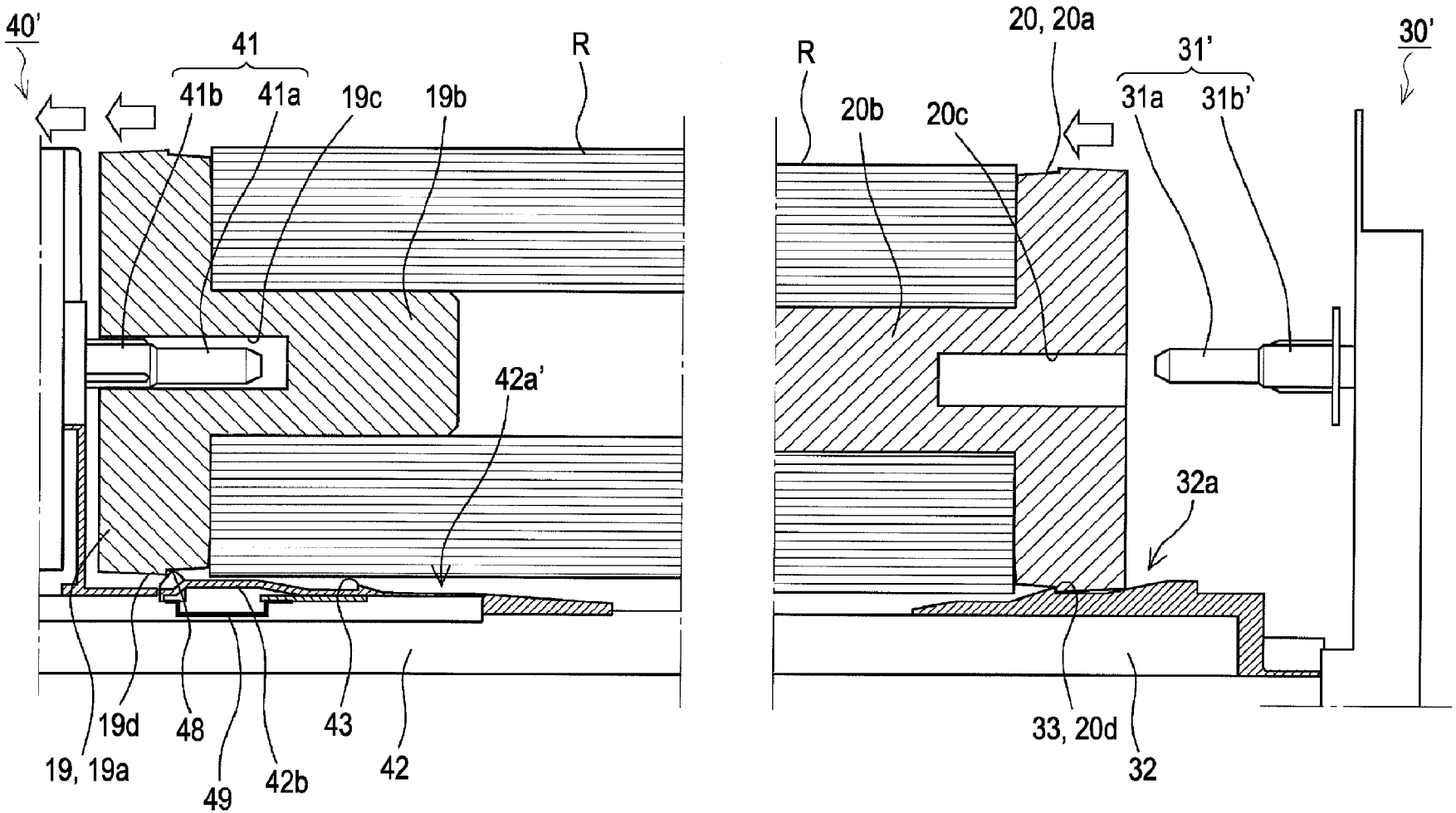
FIG. 19 is a transverse cross-section of the movable-side holder and the fixed-side holder.
Figure 20:
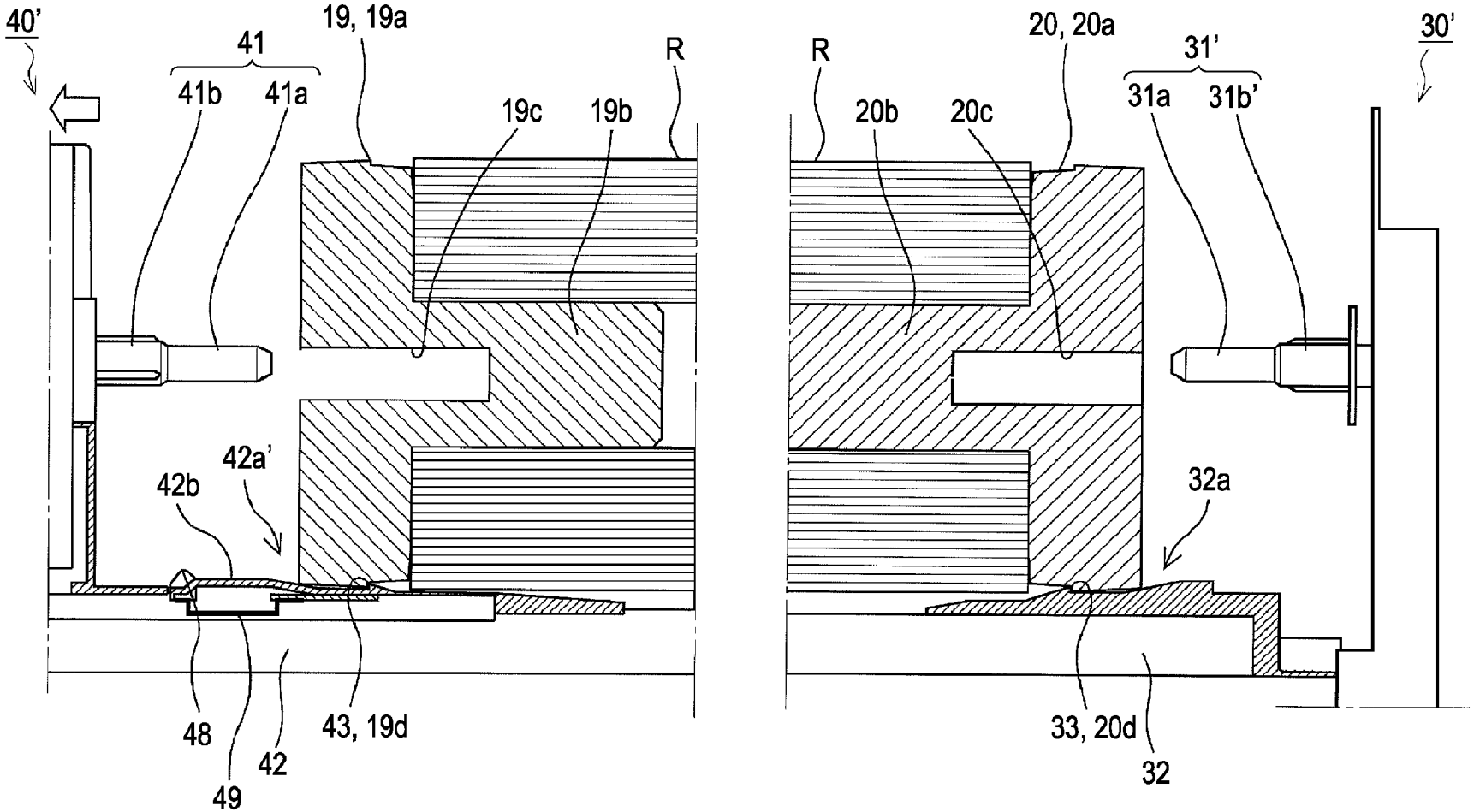
FIG. 20 is a transverse cross-section of the movable-side holder and the fixed-side holder.

If the movable-side holder 40' is moved further away from the fixed-side holder 30, because the step portion 19*d* of the movable-side flange 19 is engaged with the holder-side engaging portion 48 as described above, the movable-side flange 19 (i.e., the roll R) moves away from the fixed-side holder 30' along with the movable-side holder 40'. Then, as shown in FIG. 19, the driving shaft 31' is removed from the shaft hole 20*c* in the fixed-side flange 20. Thus, the driving shaft 31' is certainly removed from the shaft hole 20*c* in the fixed-side flange 20 before the driven shaft 41 is removed from the shaft hole 19*c* in the movable-side flange 19.

Unlike the above-described fixed-side holder 30, the fixed-side holder 30' according to this embodiment does not have the spiral guide groove 31*c* (FIG. 7B) in the driving shaft 31', and therefore does not restrict movement of the fixed-side flange 20 toward the movable-side holder 40'.

Accordingly, when the movable-side holder 40' is moved away from the fixed-side holder 30', the driving shaft 31' may be removed from the shaft hole 20*c* in the fixed-side flange 20 without the step portion 19*d* of the movable-side flange 19 being engaged with the holder-side engaging portion 48, depending on the magnitude of friction between the shaft hole 19*c* in the movable-side flange 19 and the driven shaft 41 and between the shaft hole 20*c* in the fixed-side flange 20 and the driving shaft 31'. However, the opposite case is also possible, and in such a case, the holder-side engaging portion 48 functions.

When the movable-side holder 40' is moved further after the driving shaft 31' is removed from the shaft hole 20*c* in the fixed-side flange 20, the step portion 20*d* of the fixed-side flange 20 engages with the engaging portion 33 of the fixed-side holder 30', as shown in FIG. 19. Thus, movement of the roll R (and the movable-side holder 40) toward the movable-side holder 40 is restricted. If the movable-side holder 40' is moved further, the step portion 19*d* of the movable-side flange 19 engages with the engaging portion 43 of the movable-side holder 40'. Thus, further movement of the movable-side holder 40' is restricted.

As has been described, the movable-side holder 40' according to this embodiment has the holder-side engaging portion 48, which serves as a shaft-removing mechanism that removes the driving shaft 31' from the shaft hole 20*c* in the fixed-side flange 20 before the driven shaft 41 is removed from the shaft hole 19*c* in the movable-side flange 19 by moving the roll R along with the movable-side holder 40' away from the fixed-side holder 30' when the movable-side holder 40' is moved away from the fixed-side holder 30'.

Thus, when a user moves the movable-side holder 40' to remove the roll R, the roll R can be prevented from being removed without the driving shaft 31' being completely removed from the fixed-side flange 20 and thus deforming the driving shaft 31' or damaging the fixed-side flange 20.

The holder-side engaging portion 48 engages with the step portion 19*d* of the movable-side flange 19 after the movable-side holder 40' is moved away from the fixed-side holder 30' by a predetermined distance. Thus, when the roll R is in a set state, the holder-side engaging portion 48 can be prevented from colliding with the movable-side flange 19 and affecting rotation of the roll R.

In addition, when the movable-side flange 19 is set to the movable-side holder 40', more specifically, in FIG. 16B, when the movable-side flange 19 moves toward the movable-side holder 40' from a position indicated by an imaginary line (denoted by reference numeral 19') to a position indicated by a solid line (in FIG. 16B, the movable-side holder 40' moves to the right), the holder-side engaging portion 48 can be retracted. Accordingly, the movable-side flange 19 can be smoothly set to the movable-side holder 40', without the step portion 19*d* of the movable-side flange 19 engaging with the holder-side engaging portion 48.

Because the holder-side engaging portion 48 receives an urging force from the leaf spring 49 while retracting, the holder-side engaging portion 48 does not easily retracts to the retracted position during removal of the roll R. This enables the step portion 19*d* of the movable-side flange 19 to be securely engaged with the holder-side engaging portion 48. That is, the magnitude of the urging force exerted by the leaf spring 49 is adjusted such that the holder-side engaging portion 48 can retract so as to enable the roll R to be mounted and such that the holder-side engaging portion 48 does not easily retract by being pushed by the step portion 19*d* of the movable-side flange 19 during removal of the roll R so that the roll R can be certainly moved along with the movable-side holder 40'.

Because the leaf spring 49 does not exert an urging force when the holder-side engaging portion 48 is at the projected position, the elastic piece 42*b* can be prevented from being plastically deformed by the urging force of the leaf spring 49.

What is claimed is:

1. A recording apparatus comprising:

a recording unit that performs recording on a recording medium wound on a roll, the roll including a first flange that is attached to one end and has a shaft hole and a first receiving portion including a step portion, and a second flange that is attached to the other end and has a shaft hole;

a first holder movable along a rotation axis of the roll, the first holder including:

a first shaft insertable into the shaft hole in the first flange; and a first flange-support surface that is in contact with an outer periphery of the first flange to support the first flange when the first shaft is not fitted in the shaft hole in the first flange and that has a first engaging portion adapted to engage with the step portion of the first receiving portion of the first flange;

a second holder including:

a second shaft insertable into the shaft hole in the second flange;

a second flange-support surface that is in contact with an outer periphery of the second flange to support the second flange when the second shaft is not fitted in the shaft hole in the second flange; and a flange guide mechanism that guides the second flange to a reference position located on the second holder side, wherein, when the first holder is moved away from the second holder while the first and second shafts are fitted in the shaft holes in the first and second flanges, respectively, the first engaging portion engages with the step portion of the first receiving portion to move the roll along with the first holder away from the second holder.

2. The recording apparatus according to claim 1, wherein the second flange has a second receiving portion, and wherein the second flange-support surface has a second engaging portion engageable with the second receiving portion to limit movement of the roll toward the first holder.

3. The recording apparatus according to claim 1, wherein the flange guide mechanism includes a boss provided inside the shaft hole in the second flange and a guide groove that is formed in the second shaft and guides the boss to a guide position as the second shaft rotates.

4. The recording apparatus according to claim 1, wherein the first flange-support surface and the second flange-support surface are shaped so as not to interfere with outer peripheral corners of the roll when the first flange-support surface and the second flange-support surface support the first flange and the second flange, respectively.

5. The recording apparatus according to claim 1, further comprising a wall portion provided so as to face an outer circumference of at least one of the first and second flanges when the first and second shafts are fitted in the shaft holes in the first and second flanges, respectively, at a position adjacent to a position from which the roll is to be set to a position where the roll is supported by the first and second holders.

6. The recording apparatus according to claim 1, further comprising:

a temporary placing portion on which the roll is temporarily placed; and a projection member arranged in at least one of a path in which the first flange collides with the first shaft and a path in which the second flange collides with the second shaft when the roll is moved from the temporary placing portion to a position where the roll is supported by the first and second holders.

7. A recording apparatus comprising:

a recording unit that performs recording on a recording medium wound on a roll, the roll including a first flange that is attached to one end and has a shaft hole and a first receiving portion including a step portion, and a second flange that is attached to the other end and has a shaft hole and a second receiving portion;

a first holder movable along a rotation axis of the roll, the first holder including:

a first shaft insertable into the shaft hole in the first flange; and a first flange-support surface that is in contact with an outer periphery of the first flange to support the first flange when the first shaft is not fitted in the shaft hole in the first flange and that has a first engaging portion adapted to engage with the step portion of the first receiving portion of the first flange;

a second holder including:

a second shaft insertable into the shaft hole in the second flange; and a second flange-support surface that is in contact with an outer periphery of the second flange to support the second flange when the second shaft is not fitted in the shaft hole in the second flange and that has a second engaging portion engageable with the second receiving portion to limit movement of the roll toward the first holder, wherein, when the first holder is moved away from the second holder while the first and second shafts are fitted in the shaft holes in the first and second flanges, respectively, the first engaging portion engages with the step portion of the first receiving portion to move the roll along with the first holder away from the second holder.

* * * * *